US009063482B2

(12) United States Patent
Ikeda et al.

(10) Patent No.: US 9,063,482 B2
(45) Date of Patent: Jun. 23, 2015

(54) COOLING DEVICE AND IMAGE FORMING APPARATUS

(71) Applicants: Keisuke Ikeda, Kanagawa (JP); Tomoyasu Hirasawa, Kanagawa (JP); Masanori Saitoh, Tokyo (JP)

(72) Inventors: Keisuke Ikeda, Kanagawa (JP); Tomoyasu Hirasawa, Kanagawa (JP); Masanori Saitoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 11 days.

(21) Appl. No.: 13/850,506

(22) Filed: Mar. 26, 2013

(65) Prior Publication Data

US 2013/0259512 A1 Oct. 3, 2013

(30) Foreign Application Priority Data

Mar. 27, 2012 (JP) ..... 2012-070704
Nov. 6, 2012 (JP) ..... 2012-244842

(51) Int. Cl.
*G03G 15/20* (2006.01)
*G03G 21/20* (2006.01)

(52) U.S. Cl.
CPC ..... *G03G 15/2039* (2013.01); *G03G 21/206* (2013.01)

(58) Field of Classification Search
CPC ..... G03G 15/6573; G03G 15/2021; G03G 15/2017
USPC ..... 399/94
See application file for complete search history.

(56) References Cited

U.S. PATENT DOCUMENTS

| | | | | |
|---|---|---|---|---|
| 5,697,428 | A * | 12/1997 | Akachi | 165/104.21 |
| 7,280,795 | B2 | 10/2007 | Kakishima et al. | |
| 8,068,759 | B2 | 11/2011 | Takehara et al. | |
| 8,254,803 | B2 | 8/2012 | Fujiya et al. | |
| 2002/0039503 | A1* | 4/2002 | Yamashita et al. | 399/307 |
| 2006/0039725 | A1* | 2/2006 | Wu et al. | 399/329 |
| 2008/0247774 | A1* | 10/2008 | Koga | 399/97 |
| 2010/0008694 | A1 | 1/2010 | Okano et al. | |
| 2010/0008695 | A1 | 1/2010 | Okano et al. | |
| 2011/0030927 | A1 | 2/2011 | Okano et al. | |
| 2011/0052247 | A1 | 3/2011 | Saitoh et al. | |
| 2011/0052248 | A1 | 3/2011 | Nishimura et al. | |
| 2011/0052249 | A1 | 3/2011 | Iijima et al. | |
| 2011/0164896 | A1 | 7/2011 | Hirasawa et al. | |
| 2011/0170895 | A1 | 7/2011 | Fujiya et al. | |
| 2011/0188880 | A1 | 8/2011 | Suzuki et al. | |

(Continued)

FOREIGN PATENT DOCUMENTS

| | | | | |
|---|---|---|---|---|
| JP | 60010284 | A * | 1/1985 | G03G 21/00 |
| JP | 2005-349627 | | 12/2005 | |
| JP | 2006-258953 | | 9/2006 | |
| JP | 2009-175260 | | 8/2009 | |
| JP | 2011-227315 | | 11/2011 | |

*Primary Examiner* — Ryan Walsh
*Assistant Examiner* — Philip Marcus T Fadul
(74) *Attorney, Agent, or Firm* — Harness, Dickey & Pierce, P.L.C.

(57) ABSTRACT

A cooling device includes a cooling member including a circulation passage for liquid coolant, and a cooling surface being directly or indirectly made to contact with a recording material being conveyed to cool the recording material. The circulation passage includes multiple passage sections arranged crossing to a conveying direction of the recording material, and a folded passage section to guide the liquid coolant from one of the multiple passage sections to another one of the multiple passage sections while changing a flowing direction of the liquid coolant. The folded passage section is disposed outside of an image forming area of the recording material on the cooling surface of the cooling member.

18 Claims, 19 Drawing Sheets

(56) References Cited

U.S. PATENT DOCUMENTS

| | | | | |
|---|---|---|---|---|
| 2011/0232634 | A1* | 9/2011 | Pare et al. | 126/643 |
| 2012/0061057 | A1 | 3/2012 | Okano et al. | |
| 2012/0070180 | A1 | 3/2012 | Iijima et al. | |
| 2012/0227927 | A1 | 9/2012 | Fujiya et al. | |
| 2012/0263491 | A1 | 10/2012 | Fujiya et al. | |
| 2012/0315069 | A1* | 12/2012 | Ikeda et al. | 399/341 |
| 2012/0328346 | A1* | 12/2012 | Amita et al. | 399/341 |
| 2014/0270877 | A1* | 9/2014 | Tomino | 399/341 |
| 2014/0334858 | A1* | 11/2014 | Miyagawa et al. | 399/341 |

* cited by examiner

COOLING DEVICE AND IMAGE FORMING APPARATUS

BACKGROUND OF THE INVENTION

1. Field of the Invention

The disclosures herein relate to a cooling device used in a printer, a facsimile machine, a copy machine or the like, and an image forming apparatus provided with the cooling device.

2. Description of the Related Art

As an image forming apparatus, one type of image forming apparatus is known in which an electrophotographic technology is used for forming a toner image on a recording material. The toner image on the recording material is applied with heat and pressure to fix the toner by a fixing device. If the heated recording material after fixation is stacked in a sheet ejection tray, heat accumulated in a bundle of recording materials may soften the toner. If more recording materials are stacked on the bundle of recording materials with the softened toner, pressure is generated by the weight of the bundle of recording material. The pressure may cause a phenomenon called a "blocking" in which the recording materials are adhered to each other by the softened toner. Once a blocking occurs, toner images on the recording materials may be deamaged if the recording materials are separated forcibly.

To prevent a blocking from occurring, a cooling device is needed which can sufficiently cool down a recording material soon after fixation by heating. A cooling device for a recording material is already known that uses a cooling member, in which liquid coolant or refrigerant is circulated, to make contact directly/indirectly with a conveyed recording material to absorb heat from the recording material. For example, Japanese Laid-open Patent Application No. 2006-258953 discloses a cooling device including a cooling member in which a circulation passage of liquid coolant is provided to cool a cooling surface of the cooling member. The cooling surface is made to indirectly contact with a recording material via an endless belt. The circulation passage in the cooling member has multiple passage sections arranged in the direction perpendicular to the recording material conveying direction, and folded passage sections to connect adjacent passage sections to guide liquid coolant from an upstream passage section to a downstream passage section so that the liquid coolant can change its flowing direction around edges of the cooling member.

However, such a cooling device as disclosed in Japanese Laid-open Patent Application No. 2006-258953 may cause a defect due to its configuration that has folded passage sections of the circulation passage inside of the cooling member, as follows. The more the number of folded passage sections of the circulation passage for liquid coolant are, the stronger the cooling effect at the edges of the cooling surface of the cooling member (the edges in the direction perpendicular to the recording material conveying direction, or vicinities of the folded passage sections) becomes than the other parts of the cooling surface. This is mainly because a heat exchange area for liquid coolant contacting the inner surface of the circulation passage is larger at vicinities of the folded passage sections than at the multiple passage sections, in terms of per unit width in the direction perpendicular to the recording material conveying direction. This causes a problem with image quality such as gloss of a recording material has unevenness between the edges and the center.

SUMMARY OF THE INVENTION

It is a general object of at least one embodiment of the present invention to provide a cooling device including a cooling member in which a circulation passage of liquid coolant is configured with multiple passage sections arranged in a crossing direction to the recording material conveying direction, and a folded passage section, which can avoid a variation of the cooling effect in the direction perpendicular to the recording material conveying direction, at least within an image forming range.

According to at least one embodiment of the present invention, a cooling device includes a cooling member including a circulation passage for liquid coolant, and a cooling surface being directly or indirectly made to contact with a recording material being conveyed to cool the recording material. The circulation passage includes multiple passage sections arranged crossing to a conveying direction of the recording material, and a folded passage section to guide the liquid coolant from one of the multiple passage sections to another one of the multiple passage sections while changing a flowing direction of the liquid coolant. The folded passage section is disposed outside of an image forming area of the recording material on the cooling surface of the cooling member.

According to at least one embodiment of the present invention, the folded passage section, whose cooling effect is stronger than other sections, is disposed outside of the image forming area of the recording material on the cooling surface of the cooling member. With this configuration, it is possible to obtain a more uniform cooling effect in the direction perpendicular to the recording material conveying direction than a configuration where the folded passage section is disposed within the image forming area.

According to at least one embodiment of the present invention, it is possible to avoid a variation of the cooling effect in the direction perpendicular to the recording material conveying direction, at least within an image forming range.

BRIEF DESCRIPTION OF THE DRAWINGS

Other objects and further features of embodiments will become apparent from the following detailed description when read in conjunction with the accompanying drawings.

DESCRIPTION OF THE PREFERRED EMBODIMENTS

Figure 1:
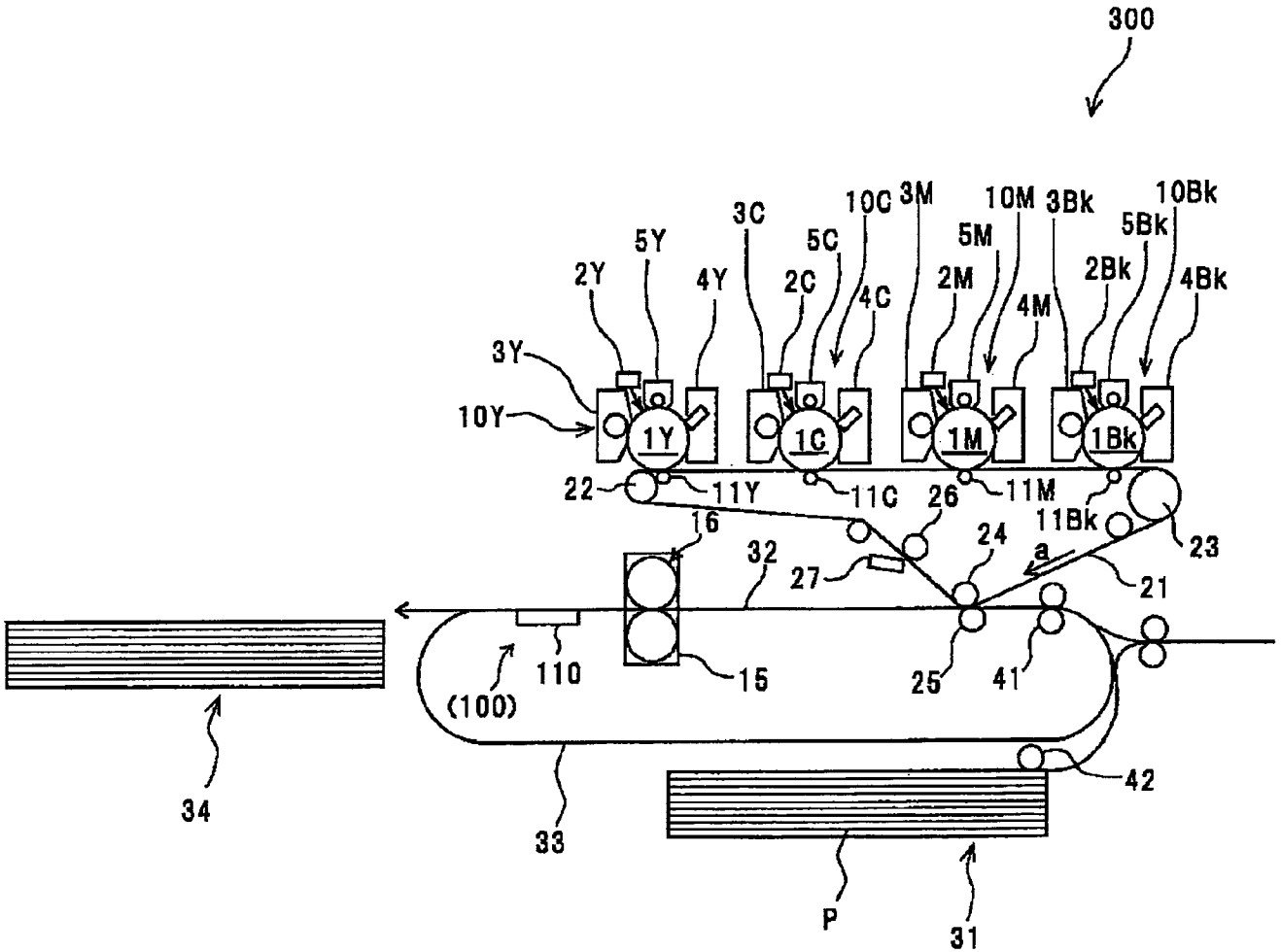
FIG. 1 is a general configuration diagram of an image forming apparatus according to an embodiment.

In the following, examples of an embodiment of the present invention, which exemplify a cooling device in an image forming apparatus, will be described with reference to the drawing. First, a printer 300 will be described, which will be commonly referred to in the following examples. FIG. 1 is a general configuration diagram of the printer 300 as an image forming apparatus according to the present embodiment.

As shown in FIG. 1, the printer 300 in the present embodiment has an intermediate transfer belt wrapped and stretched around multiple rollers (a first belt extending roller 22, a second belt extending roller 23, a third belt extending roller 24 and the like). The intermediate transfer belt 21 rotates in the direction designated by an arrow "a" in FIG. 1, driven by a rotational movement of one of the rollers 22-24. The printer 300 also has image-forming process sections disposed around the intermediate transfer belt 21. Here, suffixes after numeral codes, Y, C, M, and Bk, stand for yellow, cyan, magenta, and black, respectively, to clarify for which of the colors a part is used for.

Above the intermediate transfer belt 21 rotating in the direction designated by an arrow "a" in FIG. 1, and between the first belt extending roller 22 and the second belt extending roller 23, image stations 10 (Y, C, M, Bk) for the colors are disposed as the image-forming process sections. These are arranged in order of the image station 10Y, the image station 10C, the image station 10M, and the image station 10Bk in the moving direction of the intermediate transfer belt 21.

All the four image stations 10 (Y, C, M, Bk) have substantially the same configuration except for the color. Each of the image stations 10 (Y, C, M, Bk) includes a drum-shaped photoconductor 1, around which a charging device 5, an optical writing device 2, a developing device 3, and a photoconductor cleaning device 4 are arranged. At the opposite position of the photoconductor 1 across the intermediate transfer belt 21, a primary transfer roller 11 is provided for transferring an image on to the intermediate transfer belt 21. These four image stations 10 (Y, C, M, Bk) are arranged in the moving direction of the intermediate transfer belt 21 with predetermined intervals.

The printer 300 has an optical system having an LED as a light source. Alternatively, a semiconductor laser may be used as a light source in the optical system. With either light source, each of the photoconductors 1 is exposed to light according to image information.

Below the intermediate transfer belt 21, there are a sheet holder 31 for the sheet P, which is a recording material, the sheet feeding roller 42, and the pair of resist rollers 41. At the opposite position of the third belt extending roller 24 extending the intermediate transfer belt 21, the secondary transfer roller 25 is disposed for transferring a toner image onto the sheet P from the intermediate transfer belt 21. In addition, a belt cleaning device 27 is disposed at the opposite position to a cleaner supporting roller 26 across the intermediate transfer belt 21. The cleaner supporting roller 26 contacts the internal surface of the intermediate transfer belt 21, whereas the belt cleaning device 27 contacts the external surface of the intermediate transfer belt 21.

A sheet conveyance passage 32 is extended from the sheet holder 31 to an ejected sheet holder 34. On the way along the sheet conveyance passage 32, a fixing device 15 is disposed at a position downstream in the sheet conveyance direction relative to the secondary transfer roller 25. The fixing device 15 includes a heat applying roller and a pressure applying roller 16. At a downstream position relative to the fixing device 15 along the sheet conveyance passage 32, a cooling device 100 is disposed for cooling a sheet P from both sides. Further downstream from the cooling device 100, the ejected sheet holder 34 is disposed for ejecting the sheet P having toner fixed. Below the sheet conveyance passage 32, a reversed-sheet-conveyance passage 33 is provided for forming an image on the reverse side of the sheet P for double-side printing, which flips the sides of the sheet P that has passed through the cooling device 100 once, and feeds the sheet P to the pair of resist rollers 41 again.

An image forming process at an image station 10 proceeds as follows. It adopts a general electrostatic recording method in which the photoconductor 1 is uniformly charged by the charging device 5, which is exposed to light in the dark to form an electrostatic latent image by the optical writing device 2. The electrostatic latent image is visualized as a toner image by the developing device 3, which is transferred from the photoconductor 1 to the intermediate transfer belt 21 by the primary transfer roller 11. The surface of the photoconductor 1 after the transfer is cleaned by the photoconductor cleaning device 4. The above image forming process is executed at all of the image stations 10 (Y, C, M, Bk).

The developing devices 3 (Y, C, M, Bk) of the four image stations 10 (Y, C, M, Bk) have a visualizing function for toner of the four different colors including yellow, cyan, magenta, and black to form a full-color image. Each of the image stations includes the photoconductor 1 and the primary transfer roller 11 opposite to the photoconductor 1 across the intermediate transfer belt 21. A transfer bias is applied to the primary transfer roller 11. These parts configure a primary transfer section.

With the configuration above, an image forming area of the intermediate transfer belt 21 passes through the four image stations 10 (Y, C, M, Bk). While passing through the four image stations (Y, C, M, Bk), different color toner images are superposed one by one on the intermediate transfer belt 21 with the transfer bias applied to the primary transfer roller 11. Thus, a full-color toner image can be obtained on the image forming area by the superposed transfer, once the image forming area has passed through the primary transfer sections of the image stations 10 (Y, C, M, Bk).

The full-color toner image on the intermediate transfer belt 21 is then transferred to the sheet P. After the transfer, the intermediate transfer belt 21 is cleaned by the belt cleaning device 27. The transfer of the full-color toner image from the intermediate transfer belt 21 to the sheet P is executed as follows. A transfer bias is applied to the secondary transfer roller 25 to form a transfer electric field between the secondary transfer roller 25 and the third belt extending roller 24 across the intermediate transfer belt 21, through which the sheet P passes a nip between the secondary transfer roller 25 and the intermediate transfer belt 21. After transferring of the full-color toner image from the intermediate transfer belt to the sheet P, the full-color toner image borne on the sheet P is applied with heat and pressure at the fixing device 15 to fix the image on the sheet P to form the final full-color image on the sheet P. After that, the sheet P is cooled by the cooling device 100 before being stacked on the ejected sheet holder 34. Therefore, at the moment the sheet P is stacked on the ejected sheet holder 34, the toner on the sheet P is securely hardened to avoid the blocking phenomenon.

Next, configuration examples of the cooling member 110 included in the 100 will be described in detail according to the present embodiment. In the following, the vertical direction to the sheet conveyance direction in the cooling member 110 may be referred to as the "longitudinal direction". Also when referring to relative positions in the cooling member 110 along the longitudinal direction, a position close to the center of the longitudinal direction is referred to as "inside", whereas a position away from the center of the longitudinal direction is referred to as "outside".

Example 1

Figure 2:
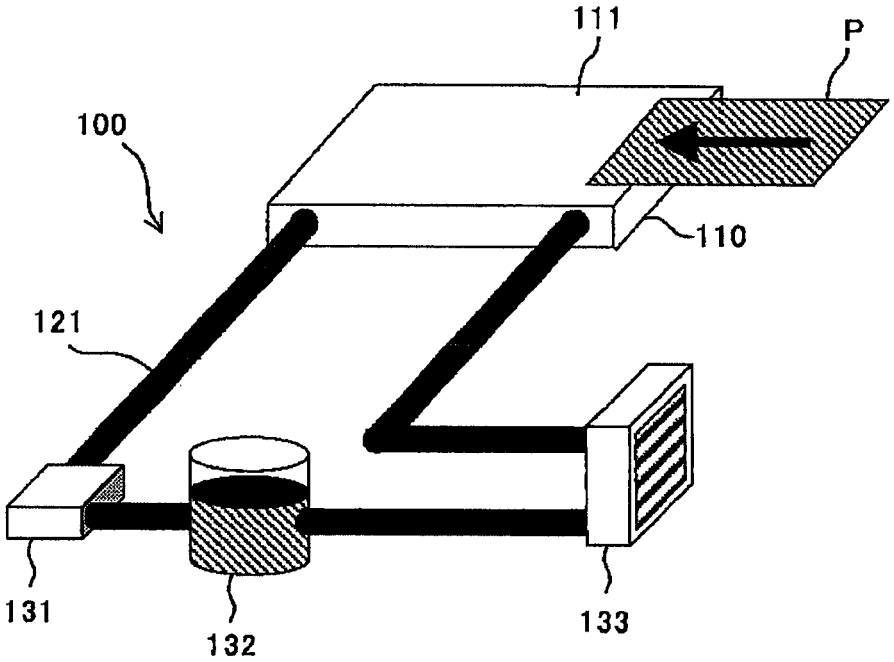
FIG. 2 is a schematic view of a cooling device according to Example 1.
Figure 3:
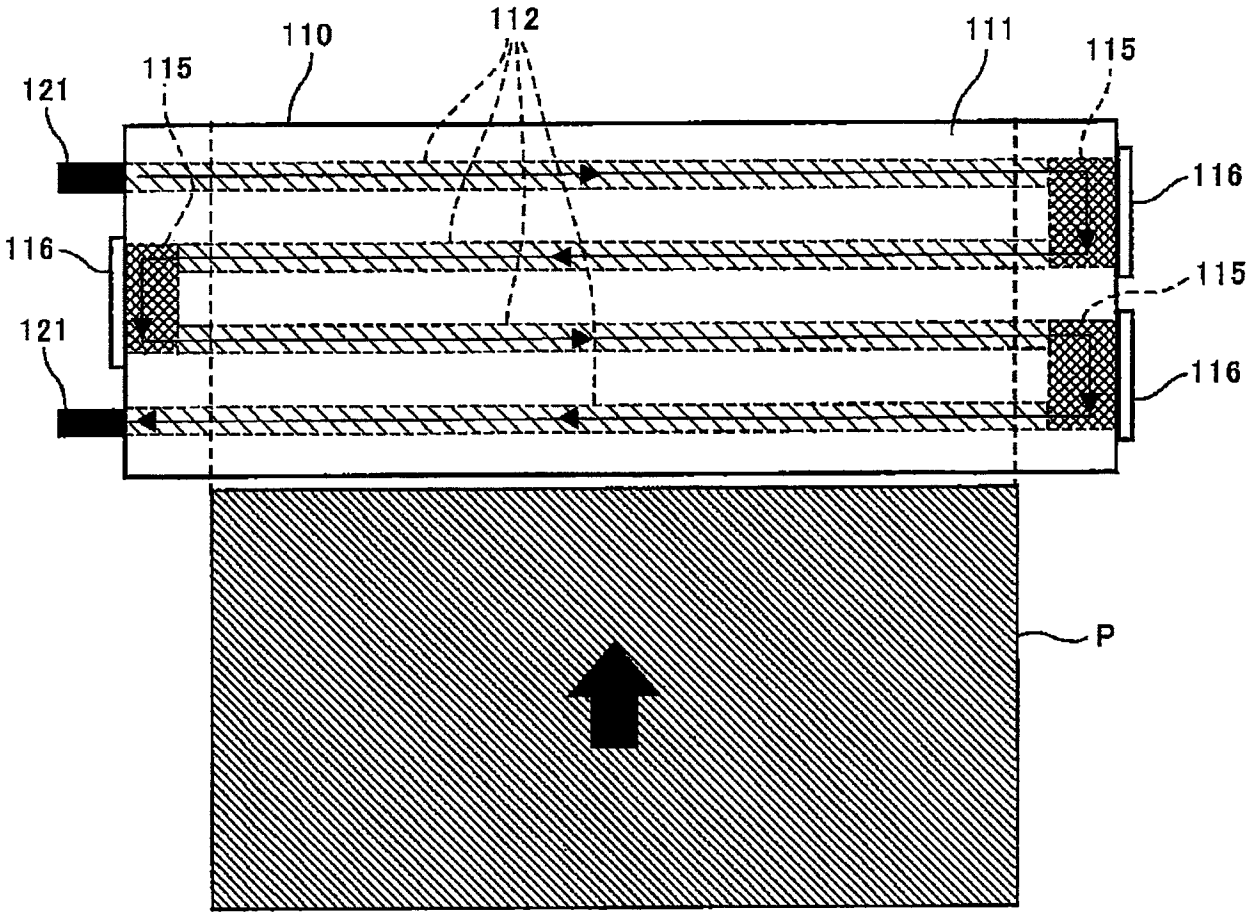
FIG. 3 is a schematic view of a cooling member of a cooling device according to Example 1.
Figure 4B:
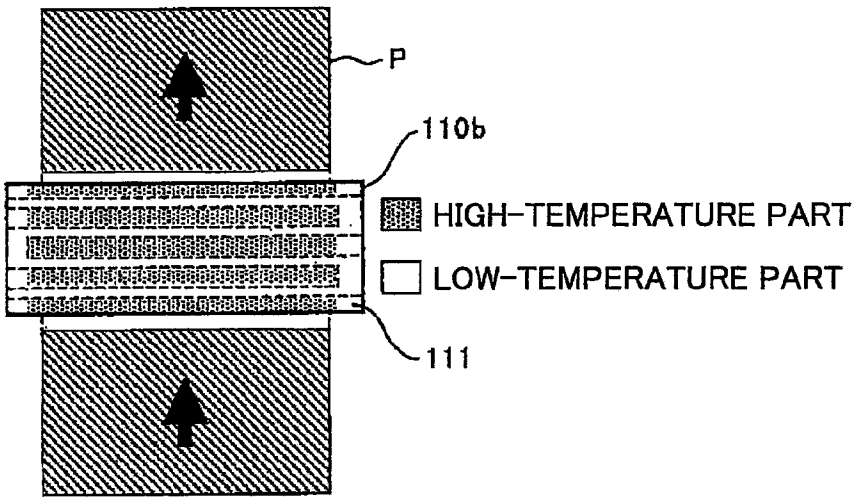
FIGS. 4A-4B are schematic views illustrating temperature distributions of cooling members when cooling a sheet.
Figure 4A:
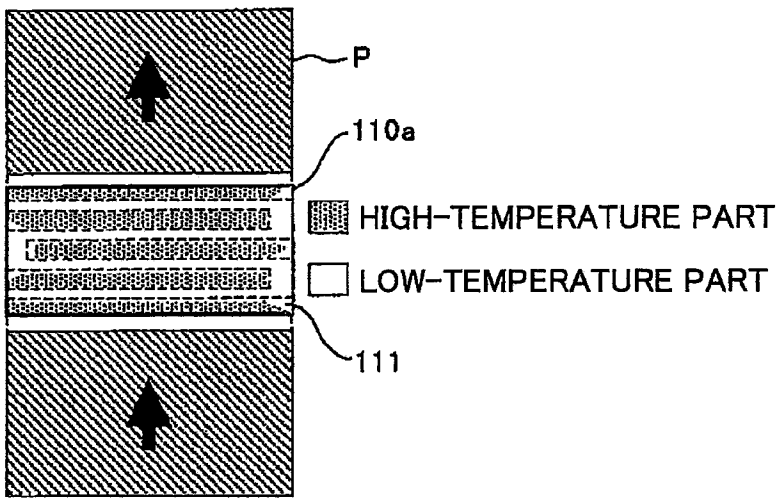
Figure 5:
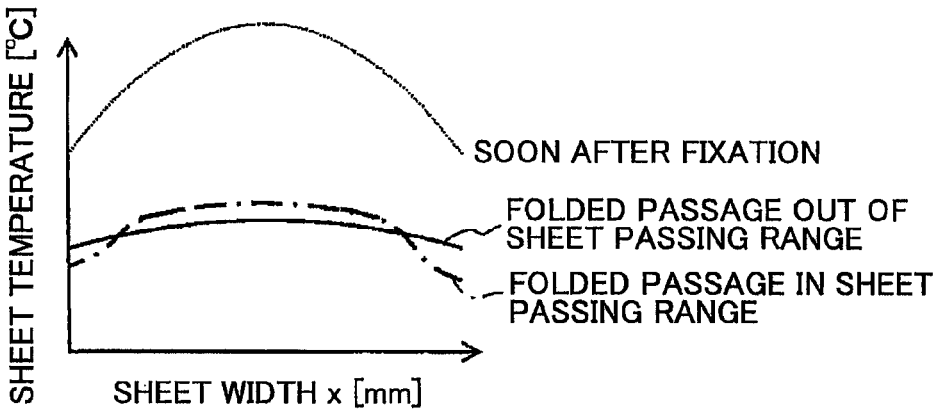
FIG. 5 is a graph illustrating temperature distributions in the direction perpendicular to the recording material conveying direction of two configuration; the one having folded passage sections arranged in the sheet passing range, and the other having folded passage arranged outside of the sheet passing range.
Figure 6A:
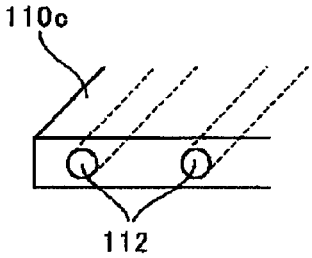
FIGS. 6A-6C are schematic views illustrating a method for forming a circulation passage in a cooling member according to Example 1.
Figure 6B:
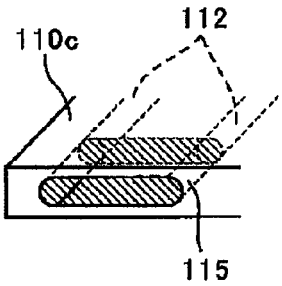
Figure 6C:
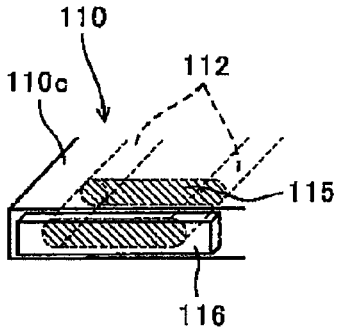
Figure 7:
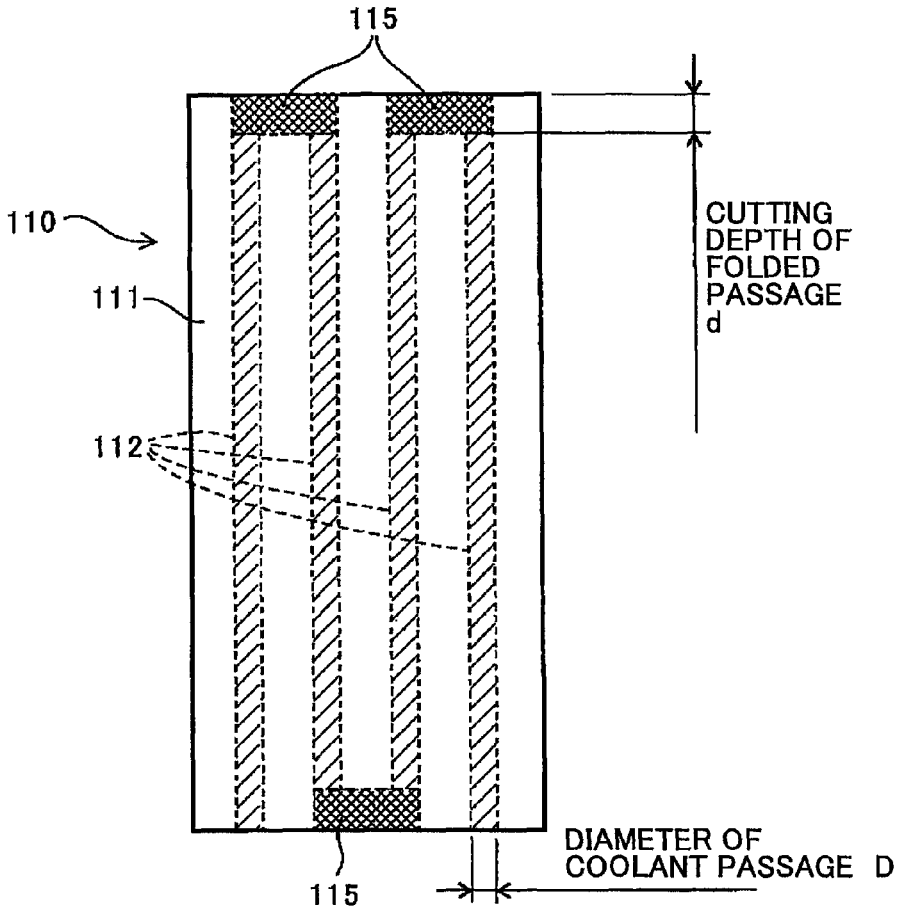
FIG. 7 is a schematic view illustrating a cutting depth of folded passage sections in a cooling member according to Example 1.
Figure 8:
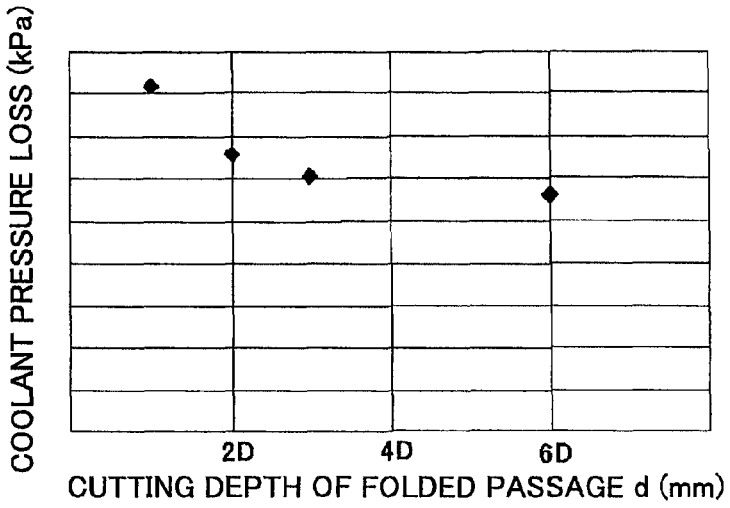
FIG. 8 is a graph illustrating a relationship between the cutting depth of folded passage sections and pressure loss of liquid coolant in a circulation passage.

The cooling device 100 in Example 1 will be described according to the present embodiment with reference to the drawing. FIG. 2 is a schematic view of the cooling device 100 according to the present example. FIG. 3 is a schematic view of the cooling member 110 of the cooling device 100 according to the present example. FIGS. 4A-4B are schematic views illustrating temperature distributions of the cooling member 110 when cooling a sheet. FIG. 4A is a schematic view of a conventional configuration having folded passage sections 115 in a sheet passing range. FIG. 4B is a schematic view of a configuration having the folded passage sections 115 outside of the sheet passing range according to the present example. FIG. 5 is a graph illustrating temperature distributions in the direction perpendicular to the recording material conveying direction of the two configurations, the one having the folded passage sections 115 in the sheet passing range, and the other having the folded passage sections 115 outside of the sheet passing range. FIGS. 6A-6C are schematic views illustrating a method for forming a circulation passage (straight passage sections 112 and a folded passage section 115) in the cooling member 110 according to the present example. FIG. 7 is a schematic view illustrating the cutting depth, d, of the folded passage sections 115 in the cooling member 110 according to the present example. FIG. 8 is a graph illustrating a relationship between the cutting depth, d, of the folded passage sections 115 and pressure loss of liquid coolant in the circulation passage according to the present example.

As shown in FIG. 2, the cooling device 100 in the present example cools down the sheet P, which has a high temperature having been applied with heat and pressure at the fixing device 15, on the cooling surface 111 by making contact with the sheet P on the cooling surface 111 formed at the upper part of the cooling member 110, and conveys the sheet P in the downstream direction in FIG. 2, designated with an arrow. By making contact with the sheet P on the cooling surface 111 of the cooling member 110, high-temperature heat of the sheet P is absorbed from the cooling surface 111 by thermal conduction to be cooled down before being ejected to the ejected sheet holder 34, hence a blocking can be avoided when stacked.

The cooling device 100 in the present example is, as shown in FIG. 2, a liquid-cooling system, having liquid coolant stored in a liquid storing tank 132, which has a liquid supplying opening (not shown) for refilling liquid coolant. The liquid coolant in the liquid storing tank 132 is fed into an external passage 121 formed with a rubber tube or the like by the liquid feeding pump 131, to be guided into the cooling member 110. After absorbing heat from the sheet P via the cooling surface 111 of the cooling member 110, the high-temperature liquid coolant is drained from the cooling member 110 to be cooled down by a radiator 133, then returned to the liquid storing tank 132. By repeating the above process to circulate the liquid coolant, the cooling member 110 can be kept at a low temperature to cool down the sheet P efficiently at the cooling device 100 after fixation in the present example. Main parts of the cooling device 100 including the liquid storing tank 132, the liquid feeding pump 131, the cooling member 110, and the radiator 133 are connected with the external passage 121, through which the liquid coolant is circulated by the liquid feeding pump 131.

In the cooling member 110 of the cooling device 100 in the present example, as shown in FIG. 3, the straight passage sections 112 are provided arranged in the direction crossing (in this case, perpendicular to) the sheet conveying direction, and parallel to each other. The folded passage sections 115 are also provided between adjacent straight passage sections 112 to redirect liquid coolant from an upstream straight passage section 112 to a downstream straight passage section 112, disposed about the edges of the cooling member 110. The internal circulation passage of liquid coolant in the cooling member 110 is configured with these straight passage sections 112 and folded passage sections 115. Liquid coolant is fed in from the external passage 121 connected with an opening of the straight passage section 112 at an upper-left position in FIG. 3, guided in the directions shown with arrows in FIG. 3, while passing through the folded passage sections 115 and straight passage sections 112. Having passed through the folded passage sections 115 and straight passage section 112, liquid coolant is drained to the external passage 121 connected with an opening of the straight passage section 112 at a lower-left position in FIG. 3.

In the cooling device 100 in the present example, the folded passage sections 115 are arranged outside of the sheet passing range on the cooling surface 111 of the cooling member 110 for potentially the widest sheet P in the printer 300 for the following reason. In the following, a cooling member 110 in a conventional configuration is referred to as the "cooling member 110*a*", whereas the cooling member 110 in the present example is referred to as the "cooling member 110*b*".

Suppose that the folded passage sections 115 are arranged inside of the sheet passing range on the cooling surface 111 of the cooling member 110*a*, on which the sheet P passes by, as in the conventional configuration. This configuration induces, as shown in FIG. 4A, low-temperature areas at the folded passage sections 115 and part of the cooling surface 111 around the folded passage sections 115. In other words, areas around the edges of the cooling member 110*a* in the direction perpendicular to the sheet conveying direction (also referred to as the "longitudinal direction" in the cooling member 110, hereafter) have a lower temperature than other areas. This causes a temperature variation in the sheet passing range on the cooling surface 111 in the longitudinal direction, which the sheet P being conveyed from the fixing device 15 to the ejected sheet holder 34 makes contact with. Here in FIG. 4A, high-temperature areas in the cooling surface 111 are shown with shading, whereas low-temperature areas in the cooling surface 111 are shown without shading.

The above phenomenon is caused mainly because the folded passage sections 115 have a larger heat-exchange area for liquid coolant contacting the inner surface of the internal circulation passage than the straight passage sections 112, in terms of per unit width in the longitudinal direction of the cooling member 110*a*.

For the same reason, the cooling member 110*b* in the present example, as shown in FIG. 4B, also has low-temperature areas around the edges of the cooling member 110*b* in the longitudinal direction of the cooling member 110*b*. Within the cooling member 110*b* in the present example, however, the folded passage sections 115 are arranged outside of the sheet passing range of the sheet P over the cooling surface 111. Therefore, a large variation of temperature on the cooling surface 111 can be avoided within the sheet passing range in the longitudinal direction when the sheet P is being conveyed from the fixing device 15 to the ejected sheet holder 34 to make contact with the cooling surface 111. Here again in FIG. 4B, high-temperature areas in the cooling surface 111 are shown with shading, whereas low-temperature areas in the cooling surface 111 are shown without shading.

Temperature distributions in the longitudinal direction of the above configurations are comparatively shown in FIG. 5. Three curves are shown, a temperature distribution of the sheet P soon after fixation, a temperature distribution corresponding to the configuration shown in FIG. 4A where the low-temperature areas, or the folded passage sections 115, are arranged within the sheet passing range of the sheet P, and a temperature distribution corresponding to the configuration shown in FIG. 4B where the low-temperature areas, or the folded passage sections 115, are arranged outside of the sheet passing range of the sheet P. As shown in FIG. 5, if the folded passage sections 115 are arranged within the sheet passing range of the sheet P, steep temperature drops can be seen around the edges, whereas if the folded passage sections 115 are arranged outside of the sheet passing range of the sheet P, gradual temperature drops can be seen.

As shown above, with the conventional configuration of the cooling member 110*a* as shown in FIG. 4A, steep temperature drops arise around the edges of the cooling surface 111 in the longitudinal direction, which causes an excessive non-uniform temperature distribution on the sheet P after cooling. The excessive non-uniform temperature distribution on the sheet P caused by the cooling member 110*a* may cause a problem such that gloss or the like of the sheet P has unevenness in the longitudinal direction. On the other hand, with the configuration of the cooling member 110*b* as shown in FIG. 4B, gradual temperature drops can be obtained around the edges of the cooling surface 111 in the longitudinal direction. The gradual temperature drops can avoid an excessive non-uniformity of the cooling effect in the longitudinal direction, as well as gloss unevenness of images. Thus, in the cooling device 100 in the present example, it is possible to avoid an excessive variation of the cooling effect of the cooling surface 111 in the cooling member 110.

As shown in FIG. 3, the internal circulation passage of the cooling device 100 in the present example is configured with four straight passage sections 112 and three folded passage sections 115. By providing multiple straight passage sections 112 and folded passage sections 115 in the internal circulation passage, the internal circulation passage can be made longer to improve the cooling effect. Moreover, the conveyance direction of liquid coolant, whose cooling effect is reduced while moving from upstream to downstream along the straight passage sections 112, can be switched at multiple folded passage sections 115. Therefore, this configuration can avoid a variation of the cooling effect in the longitudinal direction better than a configuration with only one folded passage section.

As shown in FIGS. 2 and 3, the cooling device 100 in the present example has the whole of a folded passage section 115 arranged within the area of the cooling surface 111 in the cooling member 110, which has the following effects. The edges of the cooling member 110 in the printer 300 may be heated, through brackets supporting the cooling member 110, by heat generated at motors or the like driving the fixing device 15, conveyance rollers, etc., (not shown) close to the cooling member 110. Temperature rise at the heated edges of the cooling member 110 can be cooled down by the folded passage section 115 with a higher cooling effect, which makes the other part of the cooling member 110 that cools down the image forming area of the sheet P be less affected by the temperature rise at the edges. Even if the margin outside of the image forming area of the sheet P is positioned outside of the folded passage sections 115, it is possible to avoid a steep change of moisture content between the image forming area and the margin by cooling the margin, which prevents the edges from curling.

Next, a method for forming the internal circulation passage in the cooling member 110 will be explained with reference to FIG. 6. To form the cooling member 110 having the internal circulation passage for liquid coolant with multiple folded passage sections 115, the following method can be considered. For example, first, a base member 110*c* having multiple parallel straight passage sections 112 with a circular cross section is formed of aluminum by extrusion, as shown in FIG. 6A. Next, by cutting the base member 110*c* to form a folded passage section 115 of the internal circulation passage for liquid coolant as shown in FIG. 6B, to connect the upstream 112 and the downstream 112 with each other. Finally, the cut part is sealed by a sealing member 116 as shown in FIG. 6C. To prevent leak of liquid coolant securely, the sealing member 116 is used with an O-ring, adhesive, resin such as Nano Molding Technology provided by Taiseiplas Co. Ltd., or the like.

A relationship between the shape of the folded passage section 115, or the cutting depth d specifically, and pressure loss in the internal circulation passage will be described with reference to FIGS. 7 and 8. If the number of the folded passage sections 115 increases in the cooling member 110, the pressure loss when applying pressure to liquid coolant to circulate in the cooling member 110 (the internal circulation passage) increases, which also increases workload of the liquid feeding pump 131. The pressure loss, however, can be reduced by making the cutting depth d of the folded passage section 115 shown in FIG. 7 greater, if the folded passage section 115 is formed as illustrated in FIGS. 6A-C.

A graph in FIG. 8 is plotted with pressure loss values of liquid coolant induced in the cooling member 110 (the internal circulation passage) when changing the cutting depth d of the folded passage section 115. As shown in FIG. 7, the diameter of the straight passage section 112 is set to D. Basically, the greater the cutting depth d is, the smaller the pressure loss of liquid coolant becomes. However, if the cutting depth d becomes too deep, there may be problems such as difficulties in the forming process, an overlap of the folded passage sections 115 of the internal circulation passage for liquid coolant with the sheet passing range, and a larger size of the cooling member 110. Therefore, it is desirable to have the cross section of a folded passage sections 115 of the internal circulation passage for liquid coolant is about twice as large as the cross section of the other part of the internal circulation passage for liquid coolant.

Therefore, by making the cross section of a folded passage section 115 of the internal circulation passage larger than the cross section of a straight passage section 112 arranged in parallel, it is possible to reduce the pressure loss at the folded passage section 115.

Example 2

Figure 9:
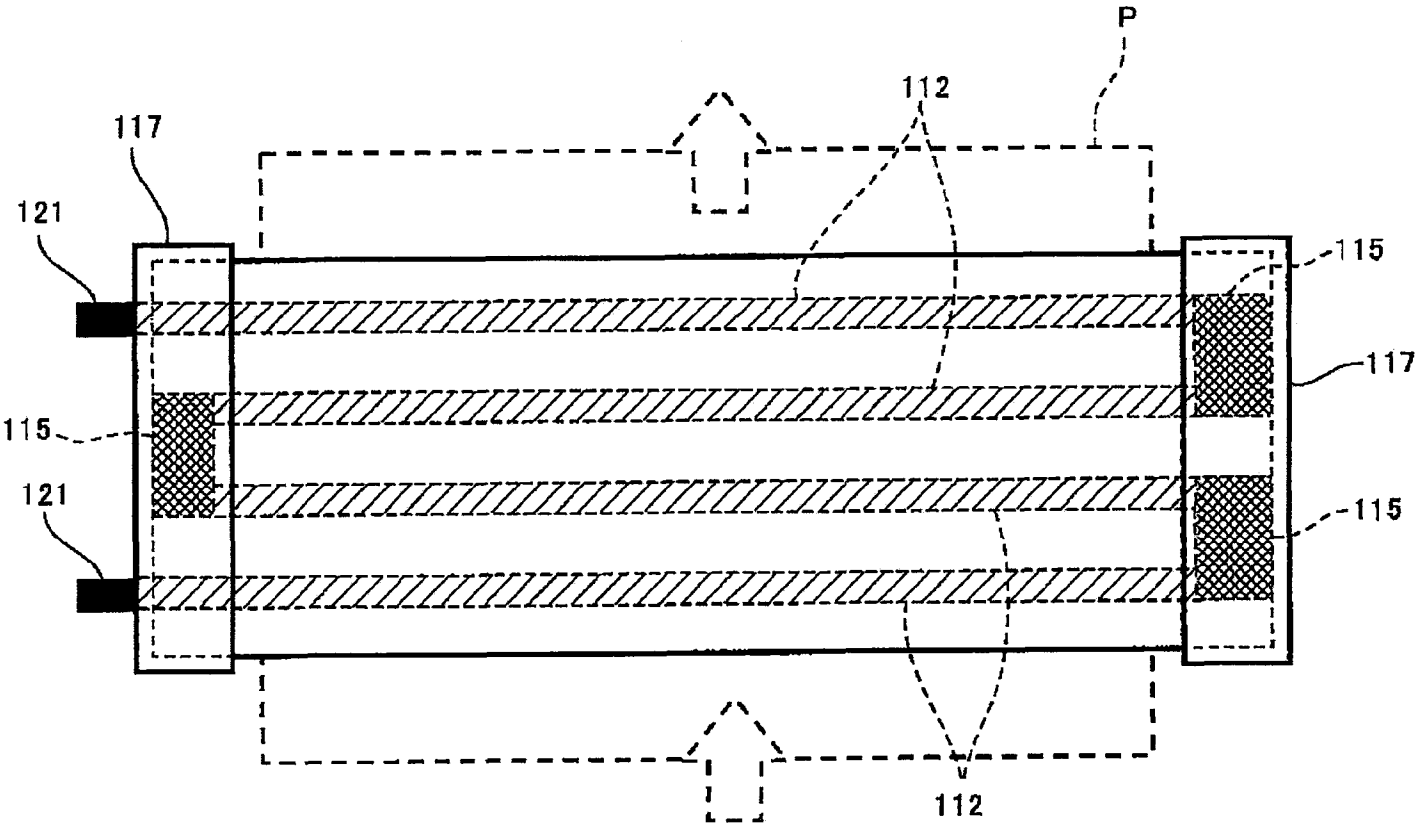
FIG. 9 is a schematic view of a cooling member of a cooling device according to Example 2.

The cooling device 100 in Example 2 will be explained with reference to FIG. 9. The only difference between Example 1 and the present example is that the cooling member 110 is covered with a heat insulation member 117 at a range outside of the sheet passing range of the sheet P where the folded passage sections 115 are arranged in the cooling device 100 in the present example. Therefore, explanations for the same configurations, operations, and effects as in Example 1 may be omitted. Also, the same members as in Example 1 are attached with the same numeral codes. FIG. 9 is a schematic view of the cooling member 110 of the cooling device 100 according to the present example.

As shown in FIG. 9, the cooling member 110 is covered with the heat insulation member 117 at the range outside of the sheet passing range of the sheet P in the present example. The cooling member 110 is susceptible to dew condensation at the range outside of the sheet passing range of the sheet P in a highly humid environment because the range outside of the sheet passing range of the sheet P takes a low temperature whereas the sheet passing range of the sheet P takes a high temperature. If dew condensation occurs on the cooling member 110, water comes into a space between the cooling member 110 and the sheet P, which makes the conveyance of the sheet P less smooth, or deteriorates image quality on the sheet P. To avoid dew condensation, it is desirable to cover the range outside of the sheet passing range of the sheet P with the heat insulation member 117. Alternatively, a moisture absorbing member such as a porous material may be provided instead of the heat insulation member 117. Also, the heat insulation member 117 may cover ranges other than those shown in FIG. 9 except for ranges where the cooling surface 111 of the cooling member 110 makes contact with the sheet P.

With the cooling device 100 in the present example, by covering the range outside of the sheet passing range of the sheet P with the heat insulation member 117, it is possible to avoid dew condensation and defects caused by dew condensation.

Example 3

Figure 10:
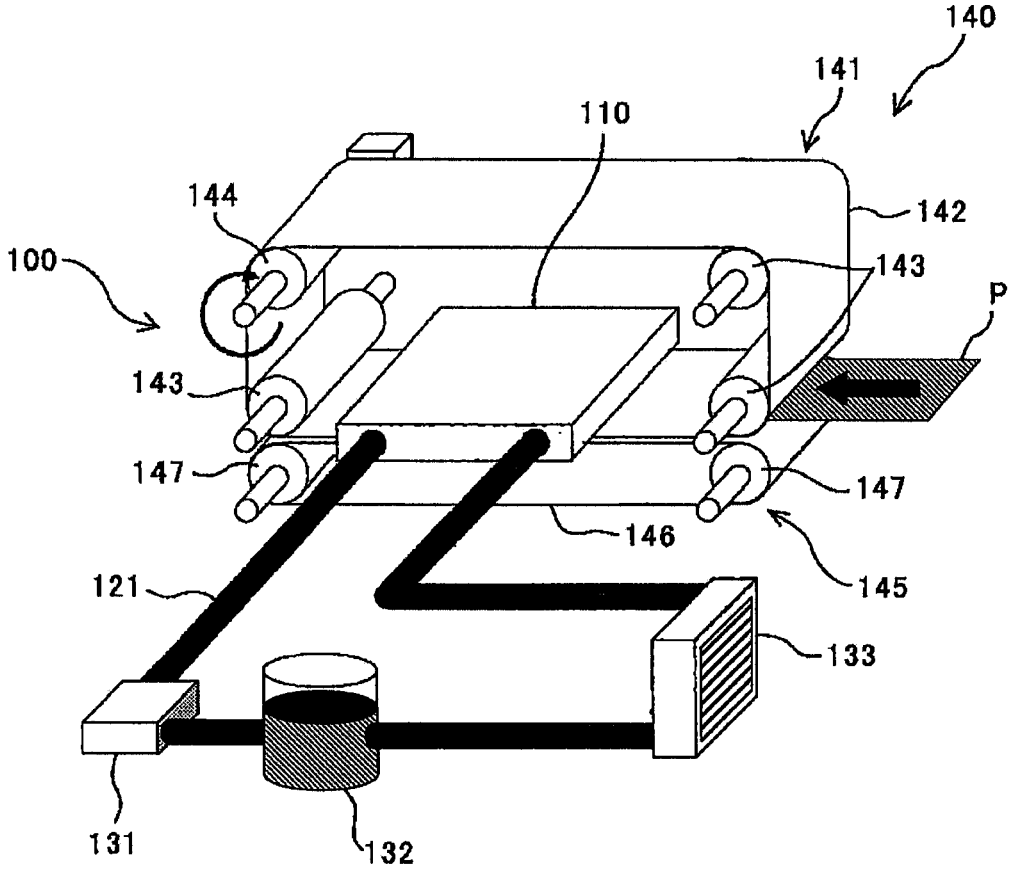
FIG. 10 is a schematic view of a cooling device according to Example 3.
Figure 11:
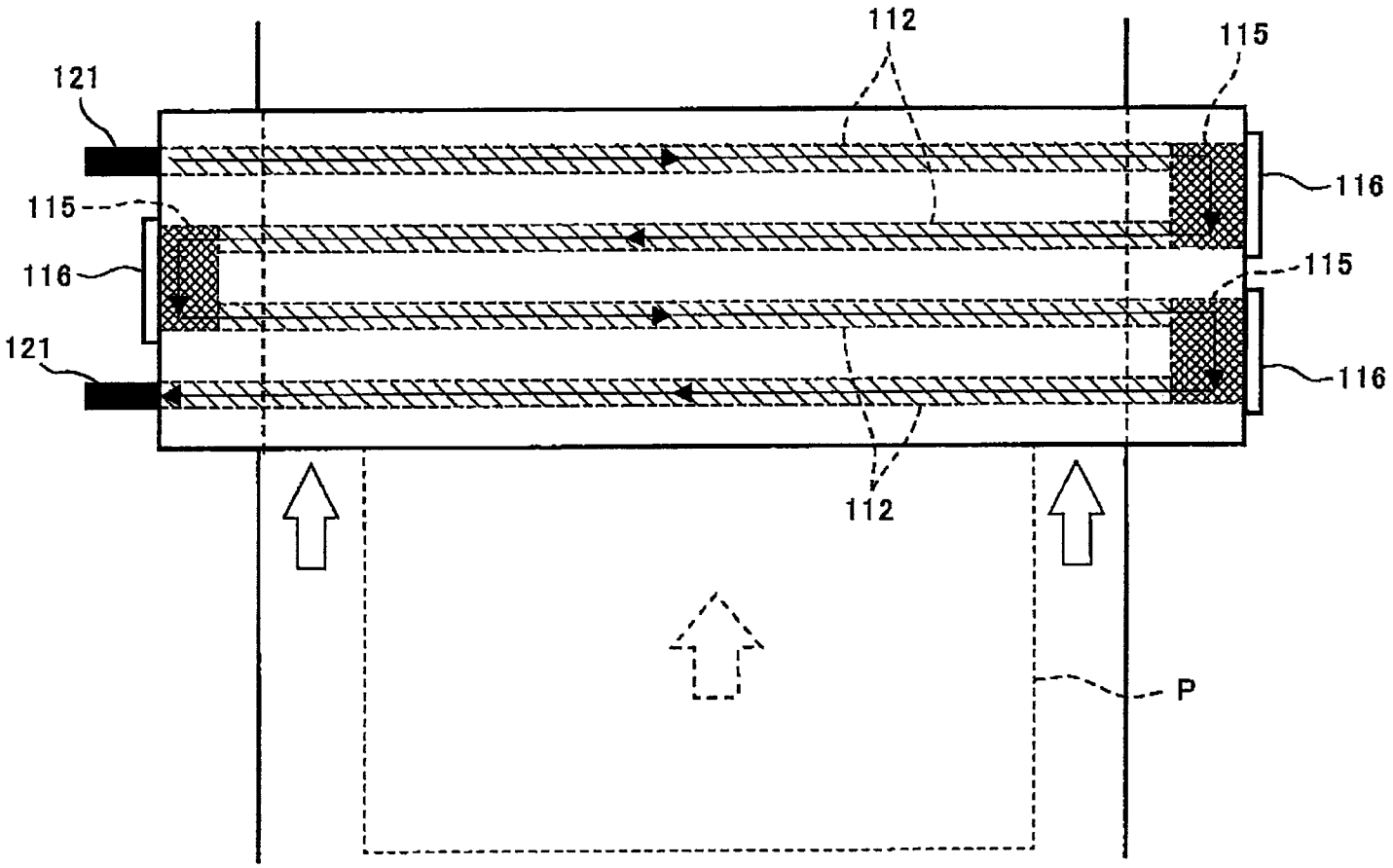
FIG. 11 is a schematic view of a cooling member of a cooling device according to Example 3.

The cooling device 100 in Example 3 will be explained with reference to FIGS. 9 and 10. The only difference between Example 1 and the present example is that the sheet P is cooled by the cooling member 110 via an endless belt in a cooling device 100 in the present example. Therefore, explanations for the same configuration, operations, and effects as in Example 1 may be omitted. Also, the same members as in Example 1 are attached with the same numeral codes. FIG. 10 is a configuration diagram of the cooling device 100 according to the present example. FIG. 11 is a schematic view of the cooling member 110 of the cooling device 100 according to the present example.

As shown in FIG. 10, the cooling device 100 in the present example has a conveyor belt device 140 for conveying the sheet P after fixation using an endless belt. The conveyor belt device 140 is configured with an upper conveyance section 141 in which the cooling member 110 is arranged so that the cooling surface 111 makes contact with the inner surface of an upper endless belt 142, and a lower conveyance section 145 that has a lower endless belt 146 opposite to the upper endless belt 142 and making contact with the upper endless belt 142 directly or across the sheet P. The upper conveyance section 141 includes multiple upper driven rollers 143 and a driving roller 144 that expand the upper endless belt 142. The lower endless belt 146 included in the lower conveyance section 145 is expanded by two lower driven rollers 147, to make contact with the upper endless belt 142 directly or across the sheet P. The upper endless belt 142 and the lower endless belt 146 hold and convey a high-temperature the sheet P in-between after fixation.

The cooling surface 111 of the cooling member 110 makes contact with the inner surface of the upper endless belt 142 from above to absorb heat from the high-temperature sheet P across the upper endless belt 142. The folded passage sections 115 of the internal circulation passage in the cooling member 110 are arranged outside of the sheet passing range of the sheet P and the upper endless belt 142 as shown in FIG. 11. With this arrangement, cooling capacity becomes more uniform than with an arrangement where the folded passage section 115 are simply arranged outside of the sheet passing range of the sheet P. In addition, the cooling surface 111 of the cooling member 110 does not directly make contact with the sheet P, to prevent a toner image after fixation from being disarranged.

In the present example, although the cooling member 110 of the cooling device 100 is arranged only in the upper conveyance section 141, the configuration is not limited to that according to the present invention. For example, in the conveyor belt device 140, both the upper conveyance section 141 and the lower conveyance section 145 are provided with the cooling members 110 so that each of the cooling members 110 is arranged opposing to the inner surface of the endless belt of one of the upper conveyance section 141 and the lower conveyance section 145. The sheet P may be held and conveyed by the upper endless belt 142 and the lower endless belt 146 after fixation. Configured in this way, the cooling effect can be enhanced because the sheet P is cooled from both sides after fixation while being conveyed. Alternatively, the cooling member 110 may be arranged in the lower conveyance section 145 to cool the sheet P from the bottom side after fixation while being conveyed.

Example 4

Figure 12:
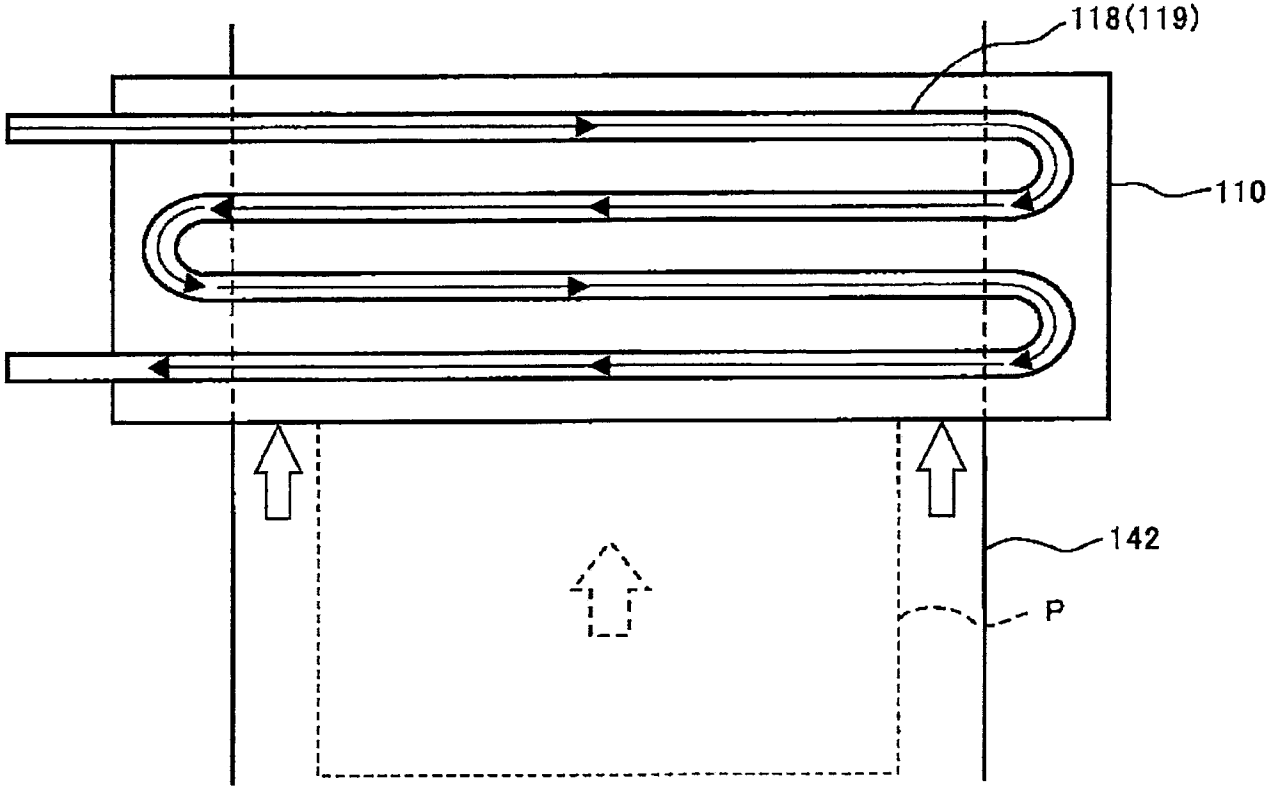
FIG. 12 is a schematic view of a cooling member of a cooling device according to Example 4.
Figure 13B:
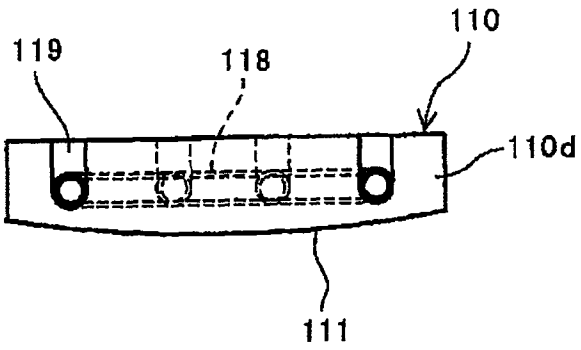
FIGS. 13A-13B are schematic views illustrating a method for producing a cooling member according to Example 4.
Figure 13A:
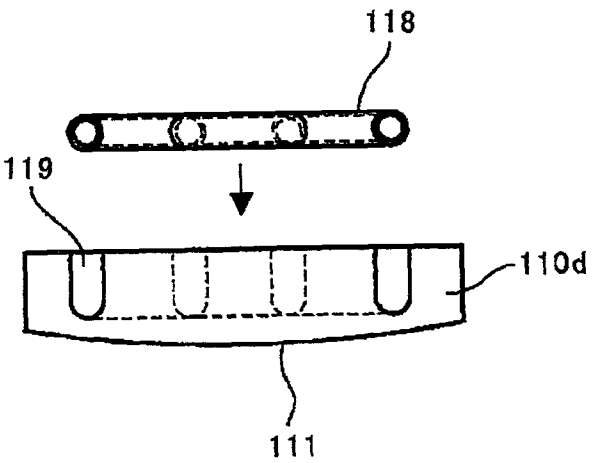

The cooling device 100 in Example 4 will be explained with reference to FIGS. 12 and 13. The only difference between Example 3 and the present example is that a conduit 118 is used to configure the internal circulation passage of the cooling member 110 in the cooling device 100 in the present example. Therefore, explanations for the same configuration, operations, and effects as in Example 3 may be omitted. Also, the same members as in Example 3 are attached with the same numeral codes. FIG. 12 is a schematic view of the cooling member 110 of the cooling device 100 according the present example. FIGS. 13A-13B are schematic views illustrating a method for producing the cooling member 110 according the present example. FIG. 13A shows the cooling member 110 before the conduit 118 is fit into a trench 118 and FIG. 13B shows the cooling member 110 after the conduit 118 has been fit into the trench 119.

As shown in FIG. 12, in the cooling device 100 in the present example, the internal circulation passage is provided by fitting the conduit 118 into the trench 119 on the base member 110*d*, instead of using extrusion or cutting on the base member 110*c* as in Examples 1 to 3. Specifically, the conduit 118 is a copper tube applied with bending work to form an R-shaped passage section including parallel straight passage sections and folded passage sections to guide liquid coolant to downstream passage sections. The base member 110*d* of the cooling member 110 is made of aluminum or the like on which the trench 119 is provided to be fitted with the conduit 118. As shown in FIGS. 13A-13B, the conduit 118 is fitted into the trench 119 on the base member 110*d* from the above. After fitting the conduit 118 into the trench 119, the conduit 118 is fixed on the cooling member 110 by heat-conductive adhesive, welding, pressure, etc.

With this the cooling member 110, the internal circulation passage for liquid coolant is the inside of the copper tube, or the conduit 118. By arranging the R-shaped passage section, or folded passage sections in the conduit 118, outside of the passing range of the sheet P or the upper endless belt 142 as shown in FIG. 12, it is also possible to obtain uniform cooling capacity for the sheet P. Furthermore, by providing the internal circulation passage with the copper tube applied with bending work to form the parallel straight passage sections and folded passage sections, it does not need a sealing at a folded passage section (R-shaped section), which reduces the risk of liquid coolant leakage.

Example 5

Figure 14A:
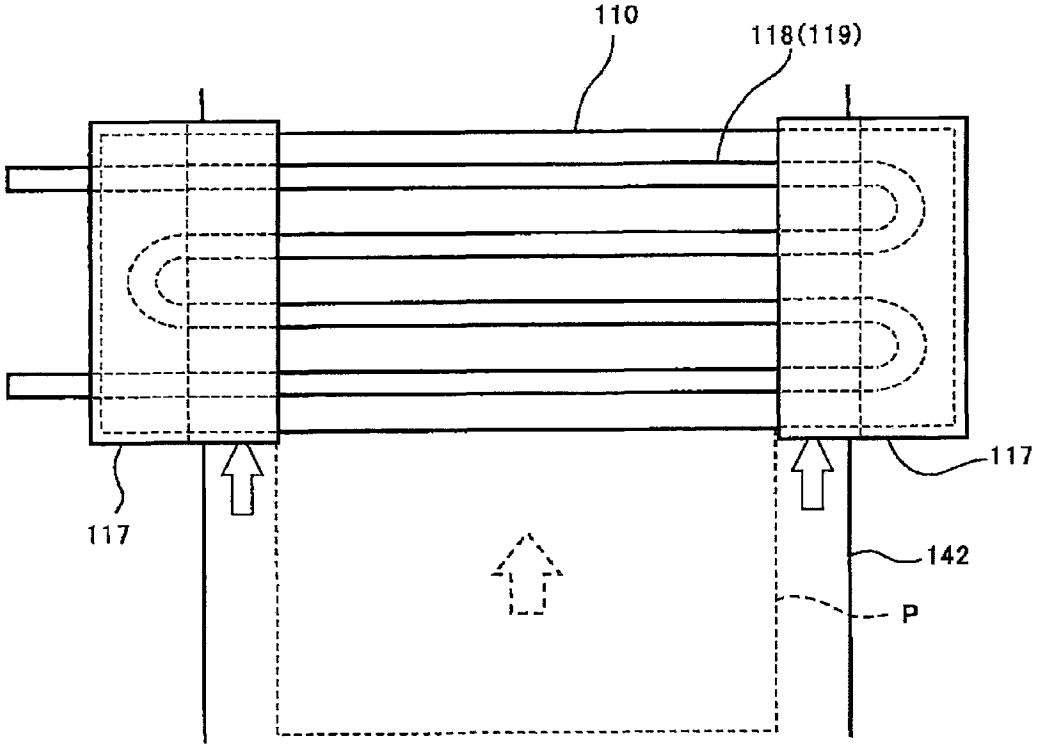
FIGS. 14A-14B are schematic views of a cooling member of a cooling device according to Example 5.
Figure 14B:
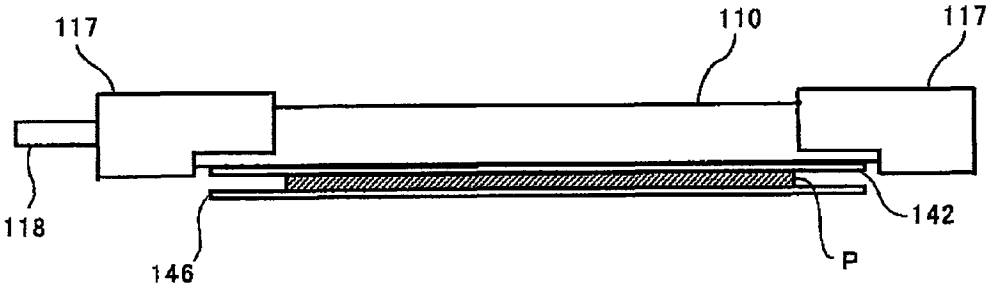

The cooling device 100 in Example 5 will be explained with reference to FIGS. 14A-14B. The only difference between Example 4 and the present example is that the cooling member 110 is covered with the heat insulation member 117 used in Example 2 above at a range outside of the sheet passing range of the sheet P and the passing range of the upper endless belt 142 where the R-shaped passage sections of the conduit 118 are arranged in the cooling device 100. Therefore, explanations for the same configuration, operations, and effects as in Example 2 and 4 may be omitted. Also, the same members as in Example 2 and are attached with the same numeral codes. FIGS. 14A-14B are schematic views of the cooling member 110 of the cooling device 100 according to the present example. FIG. 14A is a plain view of the cooling member 110 in the cooling device 100 and FIG. 14B is a cross sectional view from an upstream position in the sheet conveying direction.

The cooling device 100 of the present example includes the conveyor belt device 140 as in Example 4. Even if configured with the conveyor belt device 140, the cooling device 100 may be susceptible to dew condensation because a range outside of the heated sheet passing range of the sheet P and within the passing range of the upper endless belt 142 takes a low temperature. Therefore, in the cooling device 100 of the present example, the edges of the cooling member 110 are covered with the heat insulation member 117 as configured in Example 2 to prevent dew condensation. However, the cooling device 100 of the present example is configured differently from Example 2 in that the present example has the conveyor belt device 140, hence the following incoveniences may occur if the range of the cooling member 110 outside of the sheet passing range is covered in the same way in Example 2.

In a general conveyor belt device including an upper conveyance section and a lower conveyance section to hold and convey the sheet P, the width of endless belts in the vertical direction to the moving direction (rotation direction) is set wider than the width of the sheet P to be conveyed. Therefore, the following incoveniences may occur if the range of the cooling member 110 outside of the sheet passing range is covered in the same way as in Example 2. The endless belt may contact the heat insulation member 117 in the cooling member 110 including the endless belt, which causes problems such as a conveyance defect, a shortened lifetime of the endless belt or the heat insulation member 117, or noise.

To avoid these problems, in the cooling device 100 of the present example, as shown in FIGS. 14A-14B, the edges in the longitudinal direction of the cooling member 110 are partially covered with the heat insulation member 117 except for a range that have a possibility to come into contact with the upper endless belt 142. Namely, as shown in the cross sectional view of FIG. 14B, the edges of the cooling member 110 on the cooling surface 111 of the cooling member 110 are covered with the heat insulation member 117 outside of the passing range of the upper endless belt 142. Other parts of the edges are covered with the heat insulation member 117 outside of the sheet passing range of the sheet P By covering both edges in the longitudinal direction of the cooling member 110 with the heat insulation member 117, the following effect can be obtained. Sheet conveyance by the upper endless belt 142 including the cooling member 110 is not disturbed, and dew condensation is avoided on a range outside of the sheet passing range of the sheet P and within the passing range of the upper endless belt 142. Alternatively, a moisture absorbing member such as a porous material may be provided instead of the heat insulation member 117.

Example 6

Figure 15:
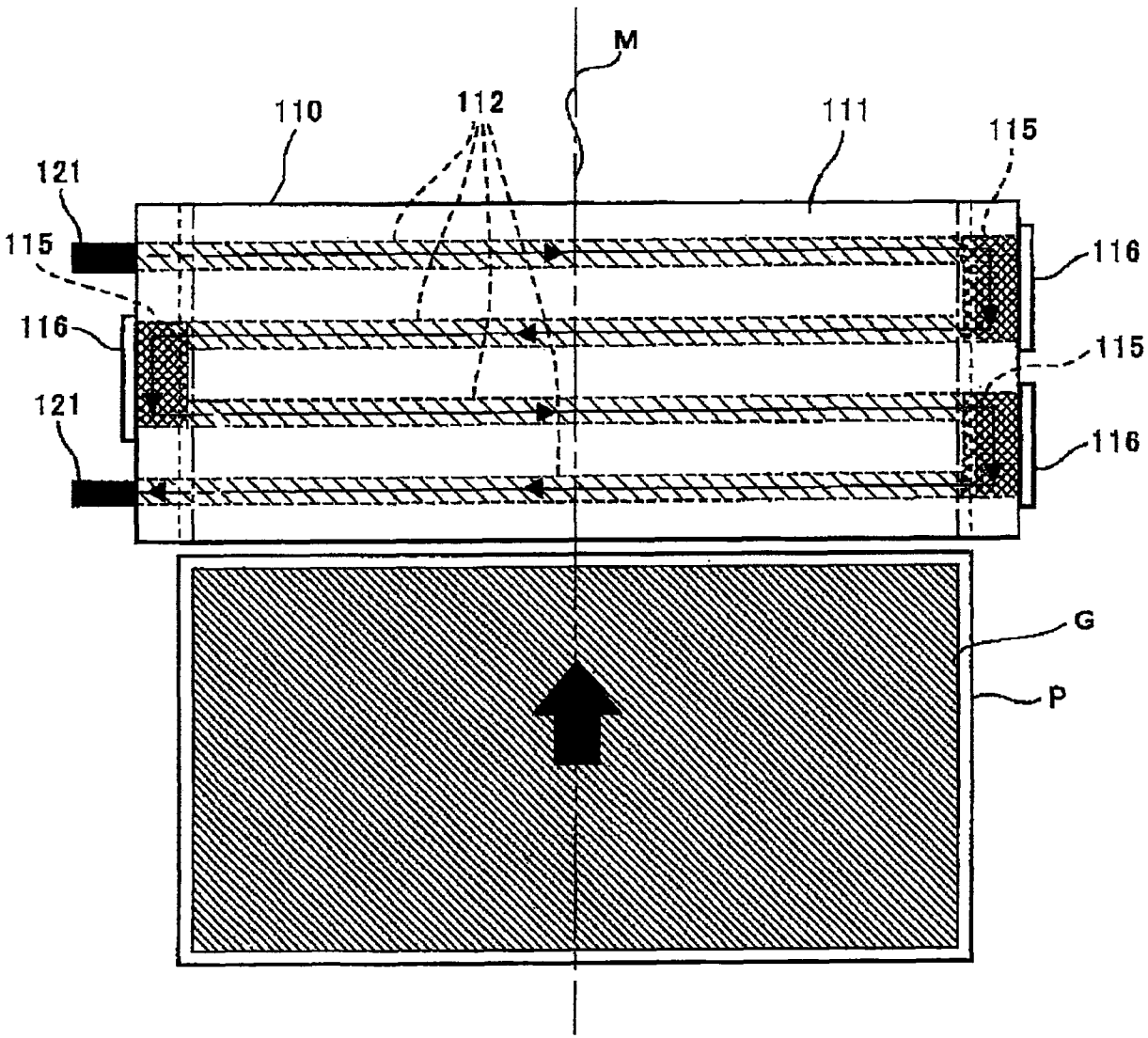
FIG. 15 is a schematic view of a cooling member of a cooling device according to Example 6.

The cooling device 100 in Example 6 will be explained with reference to FIG. 15. With Example 1 to 5 of the cooling device 100, the folded passage sections 115 are arranged outside of the sheet passing range on the cooling surface 111 of the cooling member 110 for the widest sheet P. On the other hand, with Example 6 and later of the cooling device 100, the folded passage sections 115 are arranged outside of the image forming range for the widest sheet P, which is narrower than the sheet passing range, to minimize the size of the cooling member 110 in the longitudinal direction. Moreover, favorable positions of the folded passage section 115 are derived for several shapes of the folded passage section 115, to avoid a variation of the cooling effect in the longitudinal direction of the cooling member 110, as well as to minimize the size of the cooling member 110.

Except for the difference above, the basic configuration of the cooling device 100 in Example 6 and later is the same as the basic configuration of the cooling device 100 in Example 1 to 5. Therefore, explanations for the same configuration, operations, and effects as in Example 1 to 5 may be omitted. Also, the same members as in Example 1 to 5 are attached with the same numeral codes. FIG. 15 is a schematic view of the cooling member 110 of the cooling device 100 according the present example.

In the present example, the folded passage sections 115 are arranged outside of the image forming range for the widest sheet P, for example, designated with G, where G is narrower than the sheet passing range, to minimize the size of the cooling member 110 in the longitudinal direction. Configured in this way, the image forming area of the sheet P can be cooled by a gradual temperature-variation range of the cooling surface 111 in the longitudinal direction of the cooling member 110 to prevent a steep variation of the cooling effect from being generated in the image forming area of the sheet P. In addition, the width of the cooling member 110 can be made smaller in the longitudinal direction than the width of the cooling member 110 of Example 1 to 5 by the width of margin, which is outside of the image forming area of the sheet P As explained with Example 1 to 5, a steep change of the cooling effect occurs at both edges in the longitudinal direction of the cooling surface 111 where the folded passage sections 115 are provided in the cooling member 110. In Example 1 to 5, the folded passage sections 115 are arranged outside of the sheet passing range of the sheet P to cool the sheet P by a gradual temperature-variation part of the cooling surface 111. The problem that image quality such as gloss has unevenness between the edges and the center (the sheet centerline M) in the longitudinal direction caused by a variation of the cooling effect occurs in the image forming area of the sheet P. Configured as in Example 1 to 5, the size of the cooling member 110 in the longitudinal direction is widened by the width of margin, although a variation of the cooling effect for the image forming area of the sheet P can be favorably avoided.

Therefore, in the present example, the phenomenon of the steep change of the cooling effect at the folded passage section 115 provided at both edges in the longitudinal direction of the cooling member 110 is reexamined in detail. The phenomenon, as described in Example 1 to 5, is caused mainly because the folded passage section 115 has a larger heat-exchange area for liquid coolant contacting the inner surface of the internal circulation passage than the straight passage section 112, in terms of per unit width in the longitudinal direction of the cooling member 110. There are other factors such as changes of flowing velocity of liquid coolant contacting the inner surface of the folded passage section 115 or the straight passage section 112 close to the folded passage section 115.

In principle, a cooling effect of fluid that absorbs heat by contacting an object becomes higher when the velocity of the fluid contacting to the object becomes greater. This principle is also applicable to liquid coolant that absorbs heat by contacting the inner surface of the internal circulation passage in the cooling device 100 in the examples of the present embodiment. Care should taken that an actual flowing velocity of liquid coolant contacting the inner surface of the folded passage section 115 or the straight passage section 112 close to the folded passage section 115 changes with the shape and position of the folded passage section 115.

Figure 16A:
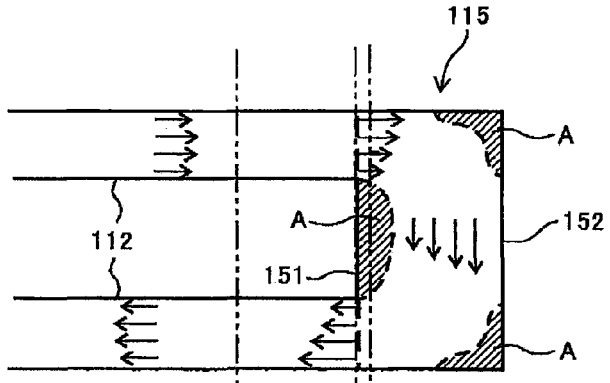
FIGS. 16A-16C are schematic views of a rectangular folded passage section in a cooling member according to Example 6, in which the inner wall surface of the rectangular folded passage section is positioned outside of an image forming area.
Figure 16B:
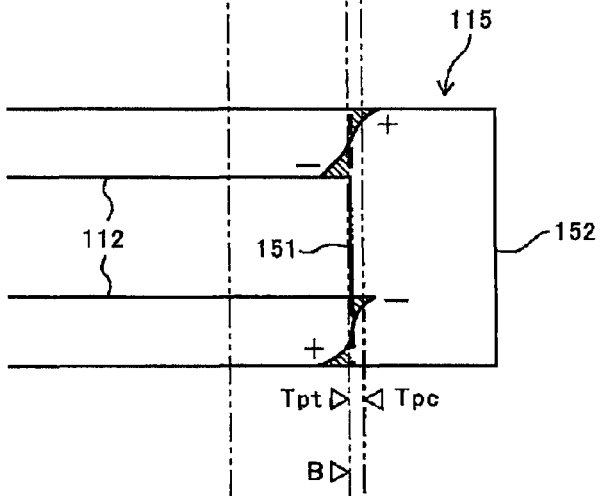
Figure 16C:
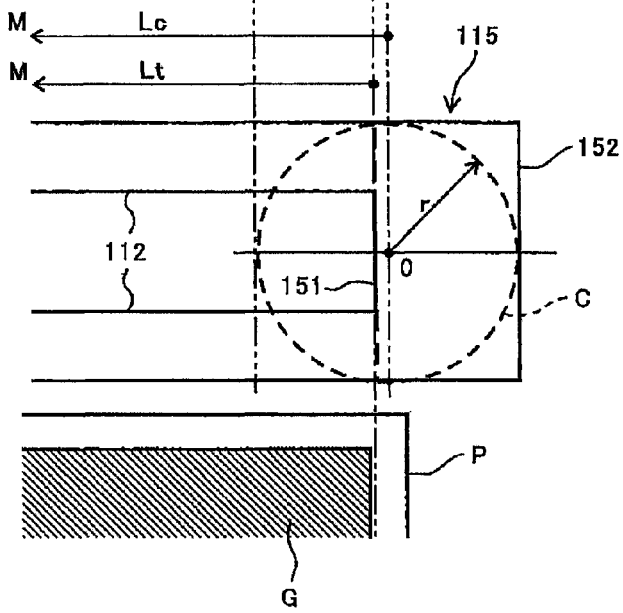

FIGS. 16A-16C are schematic views of a rectangular folded passage section 115 in the cooling member 110 according to the present example, in which the inner wall surface 151 of the folded passage section 115 is positioned outside of the image forming area. FIG. 16A is a schematic view illustrating liquid coolant flowing around a rectangular folded passage section 115. FIG. 16B is a schematic view illustrating the cooling effect around the interior inner wall surface 151 of the rectangular folded passage section 115. FIG. 16C is a schematic view illustrating relative positions of the interior inner wall surface 151 of the rectangular folded passage section 115 and the center position O of a virtual circle C, and relative positions of the image forming range G of the sheet P and a boundary position B.

Figure 17A:
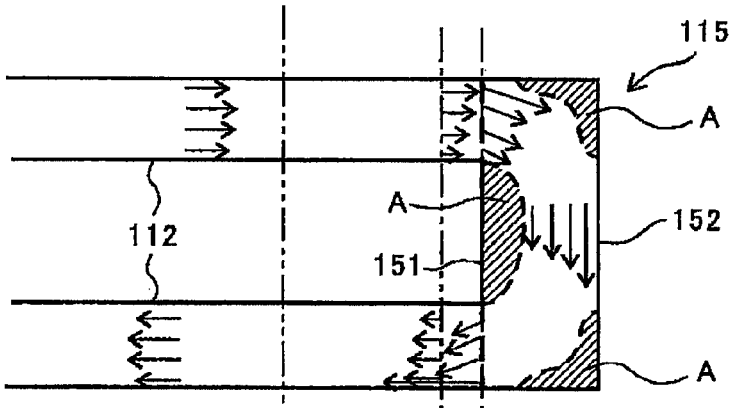
FIGS. 17A-17C are schematic views of a rectangular folded passage section in a cooling member according to Example 6, in which the center of a virtual circle inscribed in the rectangular folded passage section is positioned outside of an image forming area.
Figure 17B:
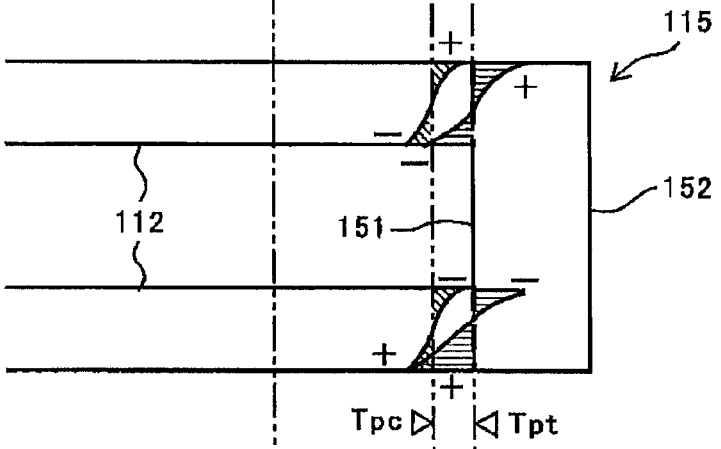
Figure 17C:
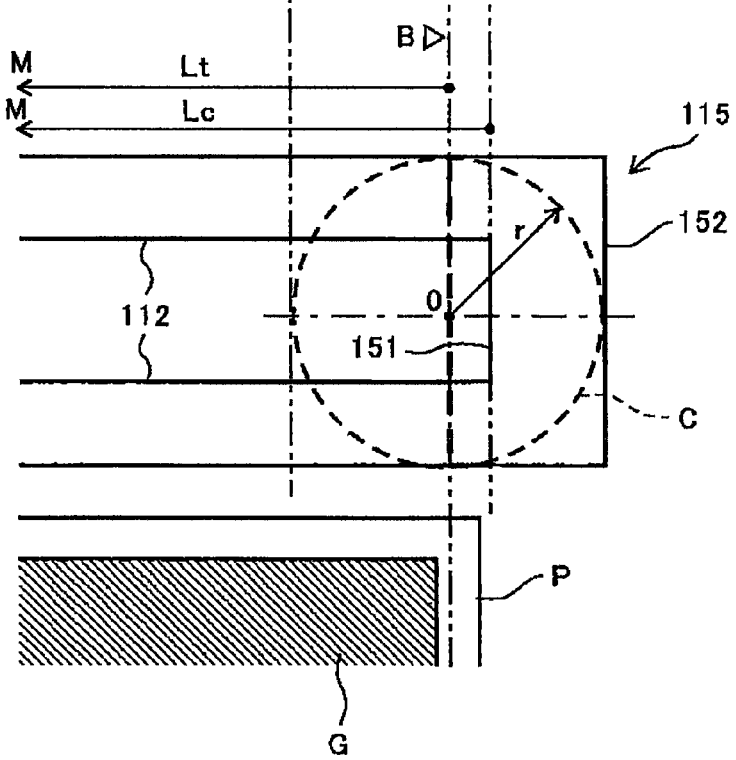

FIGS. 17A-17C are schematic views of another rectangular folded passage section 115 in the cooling member 110 according to the present example, in which the center position O of the virtual circle C is positioned outside of the image forming area. FIG. 17A is a schematic view illustrating liquid coolant flowing around the rectangular folded passage section 115. FIG. 17B is a schematic view illustrating the cooling effect around the interior inner wall surface 151 of the rectangular folded passage section 115. FIG. 17C is a schematic view illustrating relative positions of the interior inner wall surface 151 of the rectangular folded passage section 115 and the center position O of the virtual circle C, and relative positions of the image forming range G of the sheet P and the boundary position B.

In the present example, as shown in FIGS. 16 and 17, the outline of the folded passage section 115 is rectangular when the internal circulation passage of the cooling member 110 is projected on the conveyance surface of the sheet P. Here, it is assumed that the folded passage section 115 is sealed by the sealing member 116 at the edges in the longitudinal direction, and the position of the edge of the cooling member 110 in the longitudinal direction is the same as the position of the exterior inner wall surface 152 of the folded passage section 115 in the vertical direction to the sheet conveying direction.

The folded passage section 115 guides liquid coolant from an upstream straight passage section 112 to a downstream straight passage section 112 while changing the flow direction. Therefore, a notable velocity reduction of liquid coolant occurs around the outer corners of the exterior inner wall surface 152 away from the straight passage section 112, designated with A's and shading in FIG. 17A. Another notable velocity reduction of liquid coolant also occurs around the interior inner wall surface 151, which is the interior surface of the folded passage section 115 connected with the two straight passage sections 112 and parallel to the sheet conveying direction, designated also with A and shading in FIG. 17A.

The mainstream of liquid coolant avoids these velocity reduced areas to form an arc-shaped flowing path, whose velocity is greater at the exterior, and lesser at the interior. The variation of the velocity of liquid coolant generates differences of cooling effect depending on a position in the folded passage section 115. This results in a variation of the cooling effect in the straight passage section 112 depending on a position in the straight passage section 112 with which the folded passage section 115 is connected. The inventors of the present invention have found, after repeated verifications, the following tendency of the cooling effect of the straight passage section 112 connected with the folded passage section 115; the cooling effect is affected by relative positions of the interior inner wall surface 151 and the exterior inner wall surface 152. More precisely, what has been found is that there is a tendency that the cooling effect depends on relative positions of the interior inner wall surface 151 of the folded passage section 115 and a center position O of a virtual circle C. Here, the virtual circle C is a circle inscribing a virtual square; the virtual square is a square whose outer edge, or the edge away from the sheet centerline M, corresponds to the exterior inner wall surface 152.

First, suppose that the interior inner wall surface 151 of the folded passage section 115 and the center position O of the virtual circle C are at the same position, or the interior inner wall surface 151 of the folded passage section 115 is closer to the sheet centerline M than the center position O. Here, the sheet centerline M is the centerline of the sheet P when being conveyed on the cooling surface 111. Namely, the center position O of the virtual circle C is on the interior inner wall surface 151, or the center position O of the virtual circle C has a greater distance to the sheet centerline M than the interior inner wall surface 151. As shown in FIG. 16A, in a part of the straight passage section 112 that is sufficiently away from the rectangular part of the folded passage section 115, liquid coolant is conveyed parallel to the centerline of the straight passage section 112. This occurs at both the upstream straight passage section 112 supplying liquid coolant, and the downstream straight passage section 112 being supplied with liquid coolant. The velocity of liquid coolant being conveyed is faster when close to the centerline of the straight passage section 112, and slower close to the inner surface of the straight passage section 112 which liquid coolant is contacting directly.

On the other hand, in the rectangular part of the folded passage section 115, the notable velocity reduction of liquid coolant occurs around the outer corners away from the straight passage section 112, and around the interior inner wall surface 151, which is the interior surface of the folded passage section 115 connected with the two straight passage sections 112. Therefore, the mainstream of liquid coolant forms an arc-shaped flowing path, whose velocity is greater at the exterior, and lesser at the interior in a cross section of the folded passage section 115. At the boundary position Tpt of the interior inner wall surface 151 of the folded passage section 115 and the two straight passage sections 112, which is away from the outer corners of the folded passage section 115 where the notable velocity reduction of liquid coolant occurs, the conveyance direction of liquid coolant is parallel to the centerline of the straight passage section 112. The liquid coolant velocity is greater at the exterior, and lesser at the interior in a cross section of the folded passage section 115 accordance with the liquid coolant velocity in the interior inner wall surface 151 described above.

For these reason, at the boundary position Tpt of the interior inner wall surface 151 of the folded passage section 115 and the two straight passage section 112, the cooling effect is reduced at the interior where the two straight passage section 112 are relatively close to each other, whereas the cooling effect is increased at the exterior where the two straight passage section 112 are relatively away from each other, as shown in FIG. 16B with shading. However, the total cooling effect at the boundary position Tpt does not change much due to velocity variation of liquid coolant because the reduced cooling effect and the increased cooling effect are almost the same at the boundary position Tpt.

Therefore, the dominant factor affecting the cooling effect of the cooling surface 111 of the cooling member 110 in the vertical direction to the sheet conveying direction at the rectangular part of the folded passage section 115 is the increased heat-exchange area for liquid coolant contacting the inner surface of the passage, rather than the velocity variation of liquid coolant. Consequently, the cooling effect of the cooling surface 111 is notably changed at the rectangular part of the folded passage section 115, which is bounded by a boundary position B that happens to correspond to the position of the inner surface 151 as well as the boundary position Tpt in this case, as shown in FIG. 16B.

Thus, in the present example, as shown in FIG. 16C, the cooling member 110 is configured so that the boundary position B, or the interior inner wall surface 151 of the folded passage section 115 in this case, is positioned outside of the image forming range G of the sheet P. Configured in this way, it is at least possible to be less affected by the variation of the cooling effect in the image forming range G in the vertical direction to the sheet conveying direction, as well as to make the cooling member 110 smaller.

Next, the case will be described in which the interior inner wall surface 151 of the folded passage section 115 has a greater distance to the sheet centerline M than the center position O of the virtual circle C. Namely, the center position O of the virtual circle C is closer to the sheet centerline M than the interior inner wall surface 151. As shown in FIG. 17A, in a part of the straight passage section 112 that is sufficiently away from the rectangular part of the folded passage section 115, liquid coolant is conveyed parallel to the centerline of the straight passage section 112. This occurs at both the upstream straight passage section 112 supplying liquid coolant, and the downstream straight passage section 112 being supplied with liquid coolant. The velocity of liquid coolant being conveyed is faster when close to the centerline of the straight passage section 112, and slower close to the inner surface of the straight passage section 112 which liquid coolant is contacting directly.

On the other hand, in the rectangular part of the folded passage section 115, a notable velocity reduction of liquid coolant occurs around the outer corners away from the straight passage section 112, and around the interior inner wall surface 151, which is the interior surface of the folded passage section 115 connected with the two straight passage sections 112. Therefore, the main stream of liquid coolant forms an arc-shaped flowing path, whose velocity is greater at the exterior, and lesser at the interior in a cross section of the folded passage section 115.

However, the boundary position of the rectangular part of the folded passage section 115 and the two straight passage sections 112, or the interior inner wall surface 151, is closer to the outer corners where the notable velocity reduction of liquid coolant occurs than in the previous case. Therefore, at the boundary position Tpt, at the upstream part in the liquid coolant conveyance direction, the liquid coolant changes its flowing direction from the center line of the straight passage section 112 into an arc-shaped path. The liquid coolant velocity is greater at the exterior, and lesser at the interior in accordance with the liquid coolant velocity variation in a cross section of the folded passage section 115 described above.

At the boundary position Tpt, at the downstream part in the liquid coolant conveyance direction, liquid coolant is conveyed in an arc-shaped path, which is close to parallel to the straight passage section 112 at the exterior and is more tilted outward at the interior. The liquid coolant velocity is notably greater at the exterior, and lesser at the interior accordance with the liquid coolant velocity variation in a cross section of the folded passage section 115 described above.

For these reasons, at the boundary position Tpt of the rectangular part of the folded passage section 115 and the two straight passage sections 112, the cooling effect is reduced at the interior where the two straight passage sections 112 are relatively close to each other, whereas the cooling effect is increased at the exterior where the two straight passage sections 112 are relatively away from each other, as shown in FIG. 17B with shading. This is especially notable at the exterior of the arc-shaped path at the boundary position Tpt at the downstream part. Therefore, the velocity variation of liquid coolant causes the notable variation in the cooling effect, although it is still less than the cooling effect variation caused at the rectangular part of the folded passage section 115. Therefore, this part that has the notable variation in the cooling effect due to the velocity variation of liquid coolant needs to be positioned outside of the image forming range G of the sheet P to curb the variation of the cooling effect within the image forming range G of the sheet P in the vertical direction to the sheet conveying direction.

It was verified that at a boundary position Tpc corresponding to the center position of the virtual circle C, the notable increase of the cooling effect can be curbed although the cooling effect is still greater than in the previous case. At the boundary position Tpc, the reduced cooling effect and the increased cooling effect are almost the same as in the boundary position B described in the previous case. Therefore, it is possible to curb the notable variation of the cooling effect due to the velocity variation of liquid coolant at boundary position Tpc.

Thus, the boundary position B is set to boundary position Tpc if the interior inner wall surface 151 of the folded passage section 115 has a greater distance to the sheet centerline M than the center position O of the virtual circle C. As shown in FIG. 17C, the cooling member 110 is configured so that the boundary position B, or the center position O of the virtual circle C (boundary position Tpc), is positioned outside of the image forming range G of the sheet P. Configured in this way, it is at least possible to be less affected by the variation of the cooling effect in the image forming range G in the vertical direction to the sheet conveying direction, as well as to make the cooling member 110 smaller.

It is noted that, if both edges of the cooling member 110 are to be covered with the heat insulation member 117 in a configuration that the cooling surface 111 and the sheet P contacts each other directly without a belt member, the edges of the cooling member 110 are partially covered with the heat insulation member 117 at a range outside of the sheet passing range of the sheet P so that the heat insulation member 117 does not hinder the conveyance of the sheet P. In a configuration that the cooling surface 111 and the sheet P contacts each other via an endless belt of a conveyor belt device 140, the edges of the cooling member 110 are partially covered with the heat insulation member 117 at a range outside of the sheet passing range of the sheet P except for ranges that have a possibility to come into contact with the upper endless belt 142 as described in Example 5. These notes are applicable to the following Examples 7 and 8.

Example 7

Figure 18A:
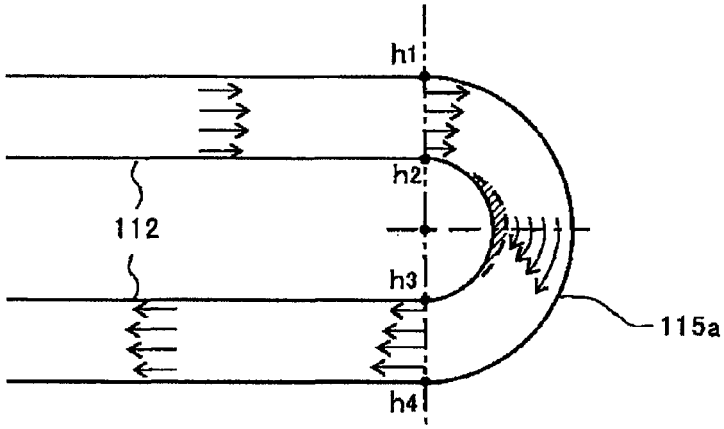
FIGS. 18A-18C are schematic views of an arc-shaped folded passage section in a cooling member according to Example 7.
Figure 18B:
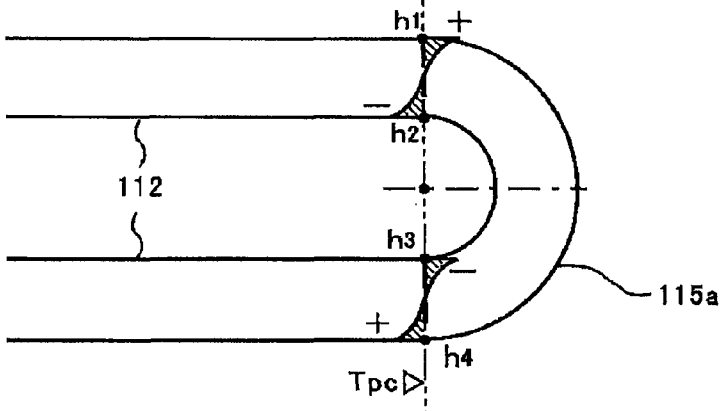
Figure 18C:
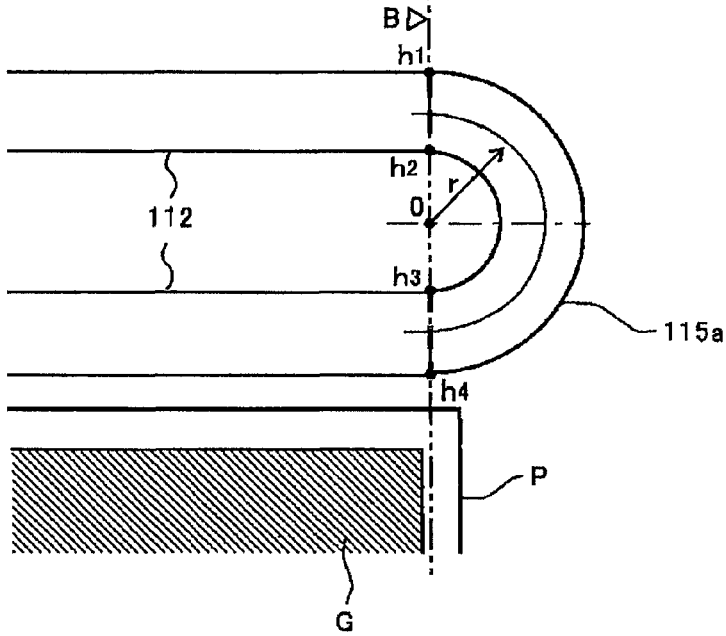

The cooling member 110 in Example 7 will be explained with reference to FIGS. 18A-18C and 19A-19C. FIGS. 18A-18C are schematic views of an arc-shaped folded passage section 115*a* in the cooling member 110 according to the present example. FIG. 18A is a schematic view illustrating liquid coolant flowing around the arc-shaped folded passage section 115*a*. FIG. 18B is a schematic view illustrating the cooling effect around the boundary position B of the arc-shaped folded passage section 115*a*. FIG. 18C is a schematic view illustrating relative positions of the image forming range G of the sheet P and the boundary position B in the arc-shaped folded passage section 115. The exterior outline and interior outline of the folded passage section 115*a* in the present example are a part of perfect circles, respectively. The circles have the same center position and different radii.

Figure 19A:
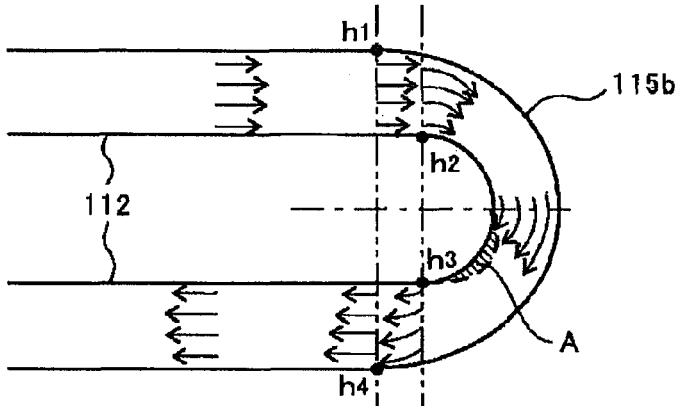
FIGS. 19A-19C are schematic views of a curved folded passage section in a cooling member according to Example 7.
Figure 19B:
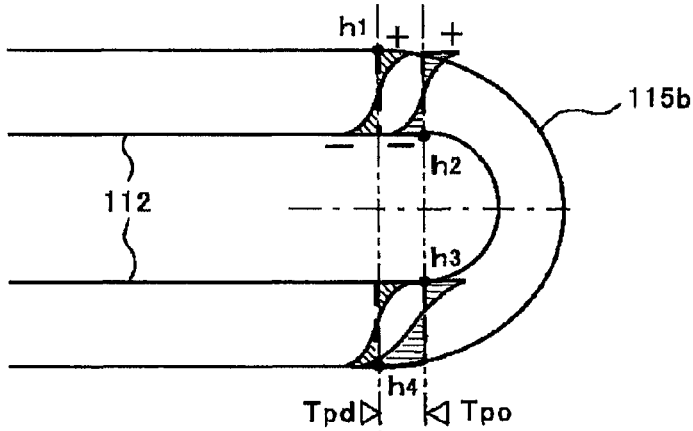
Figure 19C:
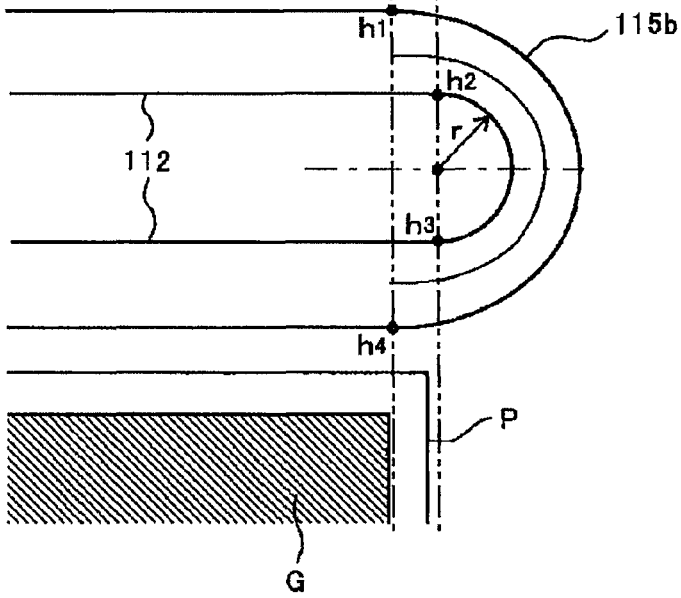

FIGS. 19A-19C are schematic views of a curved folded passage section 115*b* in the cooling member 110 according to the present example. Specifically, the interior outline is an arc and the exterior outline is a part of an oval. FIG. 19A is a schematic view illustrating liquid coolant flowing around the curved folded passage section 115*b*. FIG. 19B is a schematic view illustrating the cooling effect around the boundary position B of the curved folded passage section 115*b*. FIG. 19C is a schematic view illustrating relative positions of the image forming range G of the sheet P and the boundary position B in the curved folded passage section 115.

Figure 20A:
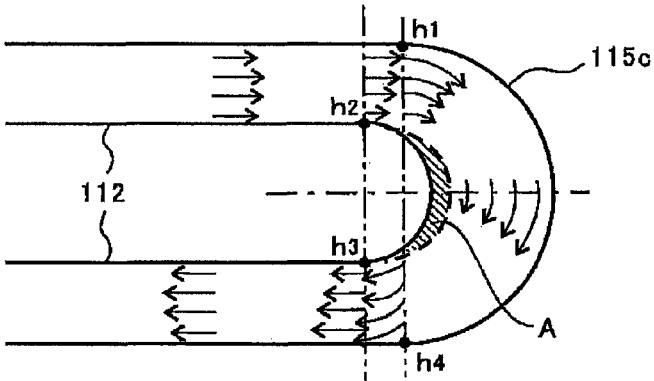
FIGS. 20A-20C are schematic views of another curved folded passage section in a cooling member according to Example 7.
Figure 20B:
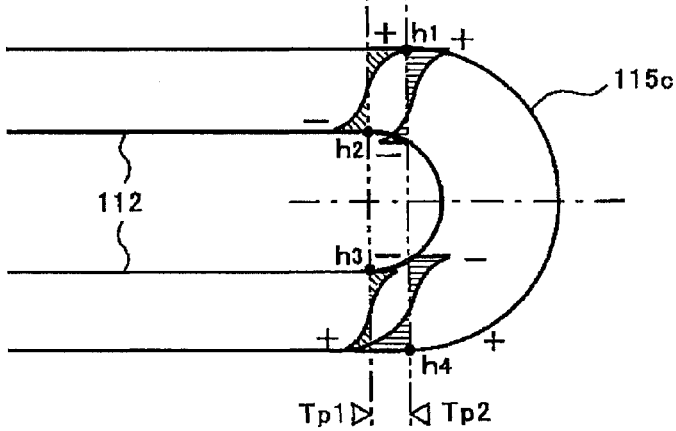
Figure 20C:
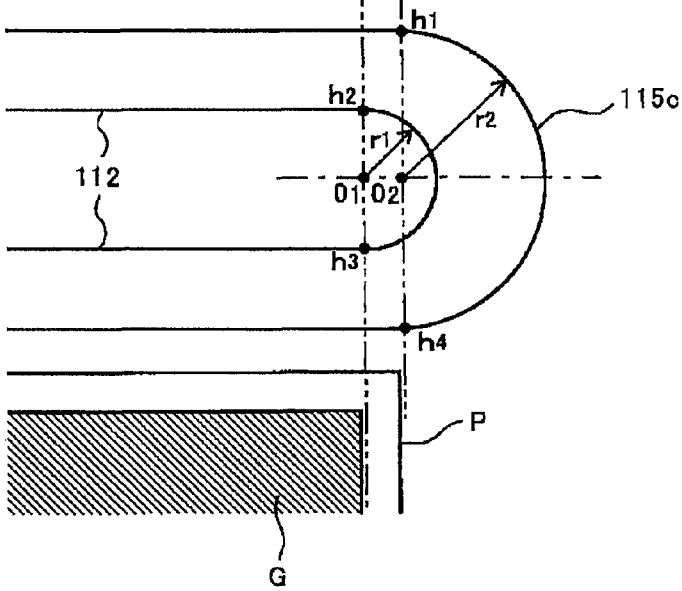

FIGS. 20A-20C are schematic views of another curved folded passage section 115*c* in the cooling member 110 according to the present example. Specifically, the interior outline and exterior outline have different center positions and different radii. FIG. 20A is a schematic view illustrating liquid coolant flowing around this curved folded passage section 115*c*. FIG. 20B is a schematic view illustrating the cooling effect around the boundary position B of this curved folded passage section 115*c*. FIG. 20C is a schematic view illustrating relative positions of the image forming range G of the sheet P and the boundary position B in this curved folded passage section 115*c*.

These cases in the present example have the interior outline and exterior outline with a fixed or varied curvature. Therefore, the velocity reduction is less likely to occur or confined in a smaller area than with the rectangular folded passage section 115 in Example 6. Therefore, these cases of the folded passage sections 115 are less affected by a velocity variation of liquid coolant than the rectangular folded passage sections 115. In the following description of these cases, the folded passage section 115 is attached with suffix a, b, c, but other common members and positions are attached with the same numeral codes because the basic configuration, operations, and effects are substantially the same.

First, the first case of a curved folded passage section 115*a* will be described with reference to FIG. 18. As shown in FIG. 18A, in a part of the straight passage section 112 that is sufficiently away from the curved part of the folded passage section 115*a*, liquid coolant is conveyed parallel to the centerline of the straight passage section 112. This occurs at both the upstream straight passage section 112 supplying liquid coolant and the downstream straight passage section 112 being supplied with liquid coolant. The velocity of liquid coolant being conveyed is faster when close to centerline of the straight passage section 112, and slower close to the inner surface of the straight passage section 112 which liquid coolant is contacting directly.

At boundary position Tpc where the folded passage section 115*a* is connected with the two straight passage section 112, there is no rectangular corner, which is different from the rectangular folded passage section 115, hence the boundary positions have arc-shaped outlines. Therefore, as shown in FIG. 18A, liquid coolant velocity may be reduced around the center of the interior inner surface of the folded section 115, but it is not as much as the notable velocity reduction occurred with the configuration in Example 6. However, within the arc-shaped part of the passage, liquid coolant velocity is reduced at positions close to the center position O, and increased at positions away from the center position O due to a centrifugal force around the center position O.

In addition, as shown in FIGS. 18A-18C, there are four inflection points h1, h2, h3, and h4, at which the flowing direction of liquid coolant starts to change, resulting in a velocity variation. Due to the centrifugal force and the velocity variation starting at the inflection points, the cooling effect is reduced at the interior where the two straight passage sections 112 are relatively close to each other, whereas the cooling effect is increased at the exterior where the two straight passage sections 112 are relatively away from each other, as shown in FIG. 16B with shading. However, the reduced cooling effect and the increased cooling effect are almost the same at the boundary position Tpc, hence the total cooling effect at the boundary position Tpt does not change much due to velocity variation of liquid coolant. Thus, with the arc-shaped folded passage section 115*a*, the boundary position B is set to the boundary position Tpc that passes the center position O of the arc.

Next, the second case of a curved folded passage section 115*b* will be described with reference to FIGS. 19A-19C. The interior outline of the folded passage section 115*b* is an arc and the exterior outline is a part of an oval. Such a shape may be generated unintentionally with an extremely thin steel tube or a thick tube on the contrary, or by a simplified bending work, or by an intentional bending work.

The interior outline and exterior outline of the curved folded passage section 115*b* have different inflection point positions in the vertical direction to the sheet conveying direction because the shapes of the interior outline and the exterior outline are different. The folded passage section 115*b* has the narrowest passage width at the line corresponding to the symmetry axis of the two straight passage sections 112 in the vertical direction to the sheet conveying direction. The interior inflection points h2 and h3 are on the boundary position Tpo on which the center position of the interior outline is positioned. The exterior inflection points h1 and h4 are on the boundary position Tpd on which of the foci of the oval, or the exterior outline, are positioned.

In addition, as shown in FIG. 19A, the boundary position Tpo, on which h2 and h3 are positioned, has a greater distance to the sheet centerline M than the boundary position Tpd, on which h1 and h4 are positioned. Therefore, liquid coolant changes its velocity and direction greater at the boundary position Tpo than at the boundary position Tpd. For these reasons, as shown in FIG. 19B, cooling effect differences arise at the boundary position Tpo, on which the inflection points of the interior outline h2 and h3 are positioned, which cannot be canceled with each other. At the boundary position Tpo, on which the inflection points of the exterior outline h1 and h4 are positioned, cooling effect differences become balanced.

As above, the two boundary positions, or the inflection points of the exterior outline and the inflection points of interior line, have different distances to the sheet centerline M. The reason why cooling effect differences become balanced at the closer boundary position Tpd to the sheet centerline M is as follows. This is because the cross section of the passage changes less when the position of the passage is closer to the sheet centerline M, hence a velocity variation caused by the change of the cross section is less. Thus, with the arc-shaped folded passage section 115*b*, the boundary position B is set to the boundary position Tpd on which the inflection points h1 and h4, and the foci of the oval, or the exterior outline, are positioned.

Next, the other case of a curved folded passage section 115*c* will be described with reference to FIGS. 20A-20C. The interior and exterior outlines of the folded passage section 115*c* are arcs, which is different from the folded passage section 115*b* above. However, the center positions of the arcs are different in the vertical direction to the sheet conveying direction. Specifically, the center position O2 of the exterior outline has a greater distance to the sheet centerline M than the center position O1 of the interior outline. In addition, the radius r2 of the exterior outline is greater than the radius r1 of the interior outline.

Namely, the folded passage section 115*c* has the widest passage width at the line corresponding to the symmetry axis of the two straight passage sections 112 in the vertical direction to the sheet of the folded passage section 115*c* perpendicular to the centerline of the passage changes proportional to passage width. Therefore, a greater velocity reduction may occur on the interior surface where the passage becomes wider than the velocity reduction in the folded passage section 115*a* or the folded passage section 115*b*.

Liquid coolant flowing from the upstream straight passage section 112 reduces its average velocity at the folded passage section 115*c* because the cross section becomes large, although the velocity at the exterior may be increased. When flowing out from the widest part to the downstream straight passage section 112, liquid coolant increases its velocity as the cross section perpendicular to the centerline of the passage becomes small. Therefore, as shown in FIG. 20A, liquid coolant velocity does not increase at the upstream position at the boundary position Tp2 that passes inflection points h1 and h4, and the center position O2 of the exterior outline, but increases at the downstream position at the boundary position Tp2. Therefore, as shown in FIG. 20B, cooling effect differences arise at the boundary position Tpd, on which inflection points of the exterior outline h1 and h2 are positioned, which cannot be canceled with each other.

At the boundary position Tp1, on which inflection points of the exterior outline h2 and h3 are positioned, cooling effect differences become balanced. As above, the two boundary position, or the inflection points of the exterior outline and the inflection points of the interior outline, have different distances to the sheet centerline M. The reason why cooling effect differences become balanced at the closer boundary position Tp1 to the sheet centerline M is the same as considered with the folded passage section 115*b*. Thus, with the arc-shaped folded passage section 115*c*, the boundary position B is set to the boundary position Tp1 on which inflection points h2 and h3, and the center position O1 of the interior outline are positioned.

As described above, the folded passage section 115*a*, the folded passage section 115*b*, and the folded passage section 115*c* are folded passage sections with curved portions. The folded passage section 115*a* has the same configuration with the folded passage section 115*c* if the center positions of the exterior and the interior arcs are made different. On the contrary, the folded passage section 115*c* has the same configuration with the folded passage section 115*a* if the exterior and the interior arcs are made to have the same center position. Namely, the folded passage section 115*a*, the folded passage section 115*b*, and the folded passage section 115*c* are of a similar configuration with curved portions.

With these folded passage sections with curved portions 115, inflection points at which the folded passage sections 115 are connected with the straight passage section 112 are positioned outside of the image forming area. Configured in this way, it is at least possible to be less affected by the variation of the cooling effect in the image forming range G in the vertical direction to the sheet conveying direction, as well as to make the cooling member 110 smaller.

Example 8

Figure 21A:
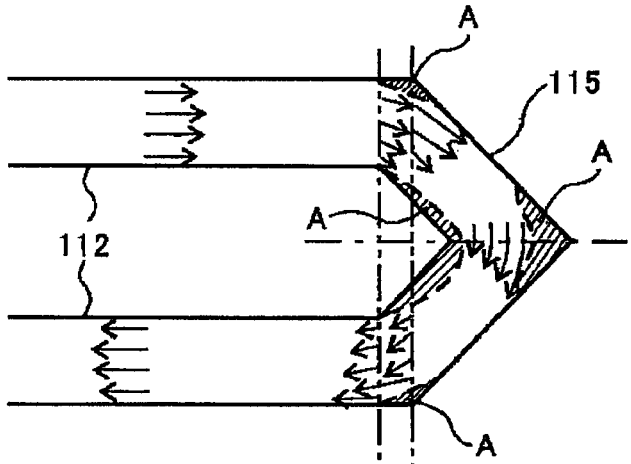
FIGS. 21A-21C are schematic views of a folded passage section in a cooling member according to Example 8.
Figure 21B:
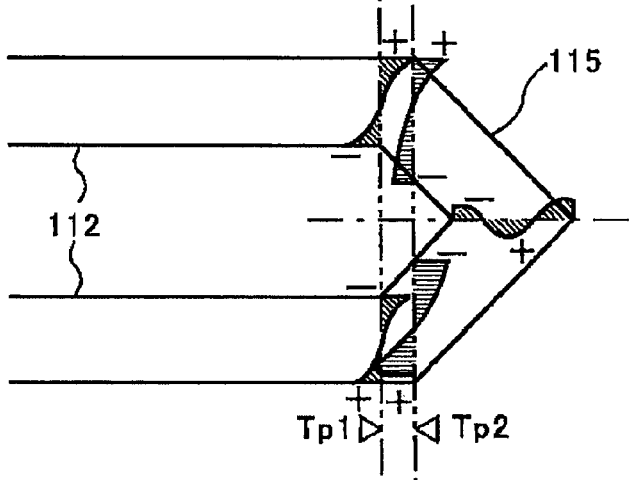
Figure 21C:
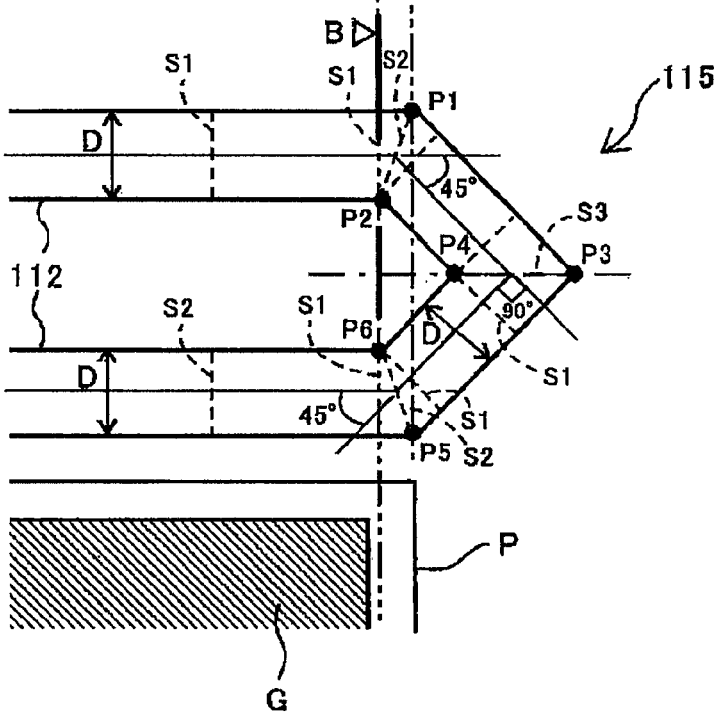

The cooling member 110 in Example 8 will be explained with reference to FIGS. 21A-21C. FIGS. 21A-21C are schematic views of the straight passage sections 112 and the folded passage section 115 in the cooling member 110 using normalized members which have a uniform cross section perpendicular to the centerline according to the present example. FIG. 21A is a schematic view illustrating liquid coolant flowing around the folded passage section 115. FIG. 21B is a schematic view illustrating the cooling effect around a boundary position where the cross section of the passage changes. FIG. 21C is a schematic view illustrating relative positions of the image forming range G of the sheet P and the boundary position B in the folded passage section 115.

In the present example, as shown in FIG. 21C, if the internal circulation passage of the cooling member 110 is projected on the conveyance surface of the sheet P, the folded passage section 115 and the straight passage sections 112 have the same width D when taken perpendicular to the centerline of the respective passage, and the same cross section S1 perpendicular to the centerline of the passage. As shown in FIG. 21C, the folded passage section 115 includes two normalized parts that are connected with each other to form a right angle. The ends of the normalized parts are connected to the straight passage sections 112, respectively, so that the two straight passage sections 112 are arranged parallel and symmetrical.

Specifically, the same steel tube is used for the straight passage sections 112 and the normalized parts, which are connected with each other so that the centerlines are crossed at the boundary surfaces between them. As shown in FIG. 21C, the upstream straight passage section 112 and the upstream normalized part of the folded passage section 115 are connected with each other so that the centerline of the upstream normalized part of the folded passage section 115 is tilted 45 degrees clockwise relative to the centerline of the upstream straight passage section 112. The centerline of the downstream normalized part of the folded passage section 115 is tilted 90 degrees clockwise relative to the centerline of the upstream normalized part of the folded passage section 115. And, the centerline of the downstream straight passage section 112 is tilted 45 degrees clockwise relative to the centerline of the downstream normalized part of the folded passage section 115.

Configured as above, three external corners P1, P3, and P5, and three internal corners P2, P4, and P6, are formed, as shown in FIG. 21C. P1 is an external connection point (called an external corner) of the upstream straight passage section 112 and the upstream folded passage section 115. P3 is an external corner of the upstream normalized part of the folded passage section 115 and the downstream normalized part of the folded passage section 115. P5 is an external corner of the downstream normalized part of the folded passage section 115 and the downstream straight passage section 112. P2 is an internal connection point (called an internal corner) of the upstream straight passage section 112 and the upstream folded passage section 115. P4 is an internal corner of the upstream normalized part of the folded passage section 115 and the downstream normalized part of the folded passage section 115. P6 is an internal corner of the downstream normalized part of the folded passage section 115 and the downstream straight passage section 112.

Although the normalized parts have the same cross section S1 perpendicular to the centerline, the cross section of a boundary surface is different from S1. For example, at the boundary surface between the upstream straight passage section 112 and the upstream normalized part of the folded passage section 115, which includes the external corner P1 and the internal corner P2, the cross section S2 is larger than S1.

When liquid coolant is conveyed through the internal circulation passage, as shown in FIG. 21A, liquid coolant velocity is reduced on the surface of the external corners. The velocity-reduced area is especially large around the external corner P3 that has the connection angle of 90 degrees. Liquid coolant velocity is also reduced at the interior, between the internal corner P2 and the internal corner P4, and between the internal corner P4 and the internal corner P6, expanding from the internal surface toward the center of passage. These velocity-reduced areas make the mainstream of liquid coolant form an arc-shaped flowing path, with a large velocity variation in the downstream normalized part of the folded passage section 115 close to the boundary surface and around external corner P5.

As a result, as shown in FIG. 21B, cooling effect differences arise at the boundary position Tp2, on which the external corner P1 and external corner P5 are positioned. At the boundary position Tp1, on which the internal corner P2 and internal corner P6 are positioned, cooling effect differences become balanced. This is because the cross section of the passage does not change at positions closer to the sheet centerline M than the boundary position Tp1, hence a velocity variation is not caused due to the change of the cross section.

Thus, with the cooling member 110 of the cooling device 100, the boundary position B is set to the boundary position Tp1 where the cross section S1 of the straight passage section 112 perpendicular to the centerline is changed to a different value in the folded passage section 115. The folded passage section 115 is disposed in the cooling member 110 so that the boundary position Tp1, on which the internal corner P2 and internal corner P6 are positioned, is placed outside of the image forming area. Configured in this way, it is at least possible to be less affected by a variation of cooling effect in the image forming range G in the vertical direction to the sheet conveying direction, as well as to make the cooling member 110 smaller.

In the above descriptions, it is assumed that the straight passage sections 112 are straight, but the shape of a straight passage section 112 is not limited to that. A straight passage section 112 may be bent at the center in the longitudinal direction of the cooling member 110 (in the vertical direction to the sheet conveying direction) so that the center is positioned downstream in the sheet conveying direction compared relative to the edges.

Further, the present invention is not limited to these embodiments and examples, but various variations and modifications may be made without departing from the scope of the present invention.

The present application is based on Japanese Priority Application No. 2012-070704 filed on Mar. 27, 2012, and Japanese Priority Application No. 2012-244842 filed on Nov. 6, 2012, with the Japanese Patent Office, the entire contents of which are hereby incorporated by reference.

What is claimed is:

1. A cooling device comprising:

a cooling member including a circulation passage for liquid coolant, and a cooling surface being directly or indirectly made to contact with a recording material being conveyed, the cooling surface configured to cool the recording material; and the circulation passage including, multiple passage sections arranged crossing a conveying direction of the recording material, and a folded passage section configured to guide the liquid coolant from one of the multiple passage sections to another one of the multiple passage sections while changing a flowing direction of the liquid coolant, wherein the folded passage section is disposed outside of an image forming area of the recording material on the cooling surface of the cooling member, and a whole of the folded passage section is embedded in an area of the cooling surface outside of a passage range of the recording material.

2. The cooling device as claimed in claim 1, wherein multiple folded passage sections are disposed in the circulation passage.

3. The cooling device as claimed in claim 1, wherein an outline of the folded passage section has a rectangular shape when the circulation passage is projected on a conveying surface of the recording material, wherein the folded passage section is disposed so that an inner edge of the outline of the folded passage section, parallel to the recording material conveying direction, closer to a centerline of the recording material being conveyed along the conveying surface than an opposing edge to the inner edge of the outline of the folded passage section, is positioned outside of the image forming area, if a center position of a virtual circle inscribing a virtual square is on the inner edge or away from the inner edge relative to the centerline of the recording material, the virtual square including an outer edge of the outline of the folded passage section as an outer edge of the virtual square, the outer edge of the outline of the folded passage section being parallel to the conveying direction of the recording material, having a greater distance to the centerline of the recording material than the inner edge.

4. The cooling device as claimed in claim 1, wherein an outline of the folded passage section has a rectangular shape when the circulation passage is projected on a conveying surface of the recording material, wherein the folded passage section is disposed so that a center position of a virtual circle inscribing a virtual square is positioned outside of the image forming area, if the center position of the virtual circle is closer to a centerline of the recording material being conveyed along the conveying surface than an inner edge of the outline of the folded passage section, the inner edge of the outline of the folded passage section, being parallel to the recording material conveying direction, and closer to the centerline of the recording material than an opposing edge to the inner edge the outline of the folded passage section, the virtual square including an outer edge of the outline of the folded passage section as an outer edge of the virtual square, the outer edge of the outline of the folded passage section being parallel to the conveying direction of the recording material, having a greater distance to the centerline of the recording material than the inner edge.

5. The cooling device as claimed in claim 1, wherein an outline of the folded passage section has a curved portion connected with an outline of the passage section when the circulation passage is projected on a conveying surface of the recording material, wherein the folded passage section is disposed so that an inflection point at which the outline of the folded passage section is connected with the outline of the passage section is positioned outside of the image forming area.

6. The cooling device as claimed in claim 1, wherein the folded passage section is disposed so that a point, at which a cross section of the folded passage section taken perpendicular to a centerline of the folded passage section becomes different from a cross section of the passage section taken perpendicular to a centerline of the passage section, is positioned outside of the image forming area.

7. The cooling device as claimed in claim 1, wherein a cross section of the folded passage section taken perpendicular to a centerline of the folded passage section is larger than a cross section of the passage section taken perpendicular to a centerline of the passage section.

8. The cooling device as claimed in claim 1, wherein an adiabatic member or a moisture absorbing member is provided on the cooling member at a range outside of a passing range of the recording material.

9. The cooling device as claimed in claim 1, further comprising:

a recording material conveying section including two belt members for holding the recording material from both sides when conveying the recording material, driven by multiple rollers expanding the belt members, wherein the cooling member is disposed so that the cooling surface of the cooling member makes contact with an inner surface of at least one of the belt members.

10. The cooling device as claimed in claim 8, wherein an adiabatic member or a moisture absorbing member is provided on the cooling surface of the cooling member at a range outside of a passing range of the belt member, as well as on other surfaces of the cooling member at a range outside of a passing range of the recording material.

11. An image forming apparatus comprising:

a fixing device to fix toner on a recording material bearing unfixed toner by applying heat and pressure; and the cooling device of claim 1, the cooling device configured to cool down the recording material after fixation.

12. The cooling device as claimed in claim 1, further comprising a belt member whose inner surface makes contact with the cooling surface of the cooling member, wherein the cooling member is disposed so that the folded passage section is disposed outside of a passing range of the belt member.

13. The cooling device as claimed in claim 1, wherein the liquid coolant is conveyed from a downstream position in the conveying direction of the recording material to an upstream position in the conveying direction of the recording material.

14. The cooling device as claimed in claim 1, wherein the cooling member has a first area and a second area that are outside of the image forming area, the first area and the second area being separated by the image forming area, and the folding passage section being arranged within the cooling member such that the folding passage section is provided at both the first area and the second area of the cooling member.

15. The cooling device as claimed in claim 1, wherein the cooling member includes a reverse surface, the reverse surface being opposite the cooling surface that contacts the recording material, the cooling surface is a curved surface, and the reverse service opposite the cooling surface is a plane surface.

16. A cooling device comprising:

a cooling member including a circulation passage for liquid coolant, and a cooling surface configured to cool a recording material by directly or indirectly contacting the recording material as the recording material is conveyed therethrough; and the circulation passage including, multiple passage sections arranged crossing a conveying direction of the recording material, and a folded passage section configured to guide the liquid coolant such that adjacent ones of the multiple passage sections in the conveying direction of the recording material have opposite flowing directions of the liquid coolant therein, wherein a whole of the folded passage section is embedded in an area of the cooling surface outside of a passage range of the recording material.

17. The cooling device of claim 16, wherein circulation passage is a continuous conduit having an inlet and an outlet, the inlet being further downstream in the conveying direction than the outlet.

18. The cooling device of claim 17, wherein the multiple passage sections of the circulation passage area arranged in a longitudinal direction perpendicular to the conveying direction such that, as the flowing direction of the liquid coolant changes as the liquid coolant flows downstream in the conveying direction through the circulation passage from the inlet, a temperature of the liquid coolant uniformly increases in the longitudinal direction.

* * * * *